US008015839B2

(12) United States Patent
Kang et al.

(10) Patent No.: US 8,015,839 B2
(45) Date of Patent: Sep. 13, 2011

(54) COOL AIR SUPPLY STRUCTURE OF STORAGE RECEPTACLE FOR REFRIGERATOR

(75) Inventors: Byeong-Gyu Kang, Gimhae (KR); Sung-Ho Shin, Gimhae (KR); Young-Woo Kim, Gimhae (KR); Jong-Suk Yoon, Pyeongtaek (KR); Yoon-Seok Bang, Bucheon (KR); Jong-Wook An, Gyeongsangnam-do (KR); Sang-Ho Park, Gimhae (KR)

(73) Assignee: LG Electronics Inc., Seoul (KR)

( * ) Notice: Subject to any disclaimer, the term of this patent is extended or adjusted under 35 U.S.C. 154(b) by 711 days.

(21) Appl. No.: 11/995,918

(22) PCT Filed: Jul. 25, 2006

(86) PCT No.: PCT/KR2006/002928

§ 371 (c)(1),
(2), (4) Date: Jan. 16, 2008

(87) PCT Pub. No.: WO2007/013760

PCT Pub. Date: Feb. 1, 2007

(65) Prior Publication Data

US 2008/0196440 A1 Aug. 21, 2008

(30) Foreign Application Priority Data

| | | |
|---|---|---|
| Jul. 29, 2005 | (KR) | 10-2005-0069902 |
| Dec. 29, 2005 | (KR) | 10-2005-0134237 |
| Jan. 4, 2006 | (KR) | 10-2006-0001053 |
| Jan. 4, 2006 | (KR) | 10-2006-0001054 |
| Jan. 4, 2006 | (KR) | 10-2006-0001056 |
| Jan. 4, 2006 | (KR) | 10-2006-0001084 |
| Jan. 6, 2006 | (KR) | 10-2006-0001851 |
| Jan. 17, 2006 | (KR) | 10-2006-0004936 |
| Jan. 17, 2006 | (KR) | 10-2006-0004937 |
| Mar. 13, 2006 | (KR) | 10-2006-0023223 |
| Mar. 13, 2006 | (KR) | 10-2006-0023226 |
| Mar. 13, 2006 | (KR) | 10-2006-0023228 |
| Mar. 14, 2006 | (KR) | 10-2006-0023359 |
| Mar. 14, 2006 | (KR) | 10-2006-0023360 |
| Mar. 14, 2006 | (KR) | 10-2006-0023361 |

(51) Int. Cl.
*F25D 17/04* (2006.01)

(52) U.S. Cl. ..... 62/408; 62/407; 62/409

(58) Field of Classification Search ..... 62/187, 62/382, 407, 408, 412, 180, 186, 225, 288, 62/414, 442; 312/404
See application file for complete search history.

(56) References Cited

U.S. PATENT DOCUMENTS 2,271,266 A * 1/1942 Kost ..... 403/355
(Continued)

FOREIGN PATENT DOCUMENTS

JP 9-113124 A 5/1997
(Continued)

OTHER PUBLICATIONS

KR2003-0039016, Refrigeration with a couple of soft-freezing rooms, May 2003, Korea, Kim et al.*

*Primary Examiner* — Frantz F Jules
*Assistant Examiner* — Emmanuel Duke
(74) *Attorney, Agent, or Firm* — Birch, Stewart, Kolasch & Birch, LLP

(57) ABSTRACT

The present invention relates to a cool air supply structure of a storage receptacle for a refrigerator. The present invention comprises one or more box casings detachably installed in a refrigerating chamber, each box casing having a mounting space and a channel through which cool air flows, the cool air being supplied from a cool air supply source through a cool air supply port formed in a side surface of the refrigerating chamber; and one or more storage receptacles, each storage receptacle being withdrawably installed in the mounting space, wherein food accommodated in an accommodation space provided in the storage receptacle is indirectly cooled by the cool air that flows through the channel. According to the present invention, there is an advantageous effect in that the food accommodated in a plurality of storage receptacles can be stored to be fresher by indirectly cooling the food and simultaneously the supply of cool air can be controlled depending on the use or not of the storage receptacles.

51 Claims, 17 Drawing Sheets

U.S. PATENT DOCUMENTS

| | | | | | |
|---|---|---|---|---|---|
| 2,704,237 | A | * | 3/1955 | Nave | 312/404 |
| 2,724,630 | A | * | 11/1955 | Saunders | 312/408 |
| 3,001,380 | A | * | 9/1961 | Ramey | 62/261 |
| 3,126,721 | A | * | 3/1964 | Shove | 62/408 |
| 3,261,585 | A | * | 7/1966 | Costantini et al. | 248/243 |
| 4,788,832 | A | * | 12/1988 | Aoki et al. | 62/382 |
| 4,870,836 | A | * | 10/1989 | Pink | 62/382 |
| 5,092,137 | A | * | 3/1992 | Elsom | 62/408 |
| 5,551,252 | A | * | 9/1996 | Lee | 62/441 |
| 5,720,185 | A | * | 2/1998 | Lee | 62/408 |
| 5,778,694 | A | * | 7/1998 | Jeong | 62/187 |
| 6,170,276 | B1 | * | 1/2001 | Mandel et al. | 62/187 |
| 6,223,553 | B1 | * | 5/2001 | Albert et al. | 62/407 |
| 6,435,902 | B1 | * | 8/2002 | Groh et al. | 439/527 |
| 6,463,752 | B2 | * | 10/2002 | Mandel et al. | 62/382 |
| 6,543,249 | B2 | * | 4/2003 | Kim et al. | 62/407 |
| 6,547,287 | B1 | * | 4/2003 | Shah et al. | 285/405 |
| 6,640,573 | B1 | * | 11/2003 | Lee | 62/266 |
| 6,694,761 | B2 | * | 2/2004 | Cho et al. | 62/186 |
| 6,817,208 | B2 | * | 11/2004 | Choi et al. | 62/408 |
| 7,263,856 | B2 | * | 9/2007 | Choi et al. | 62/408 |
| 2005/0126207 | A1 | * | 6/2005 | Lee et al. | 62/408 |

FOREIGN PATENT DOCUMENTS

| | | | | |
|---|---|---|---|---|
| KR | 20-1994-0001572 | | | 3/1994 |
| KR | 20010001298 | | * | 1/2001 |
| KR | 1020010001298 | A | | 1/2001 |
| KR | 20030038999 | | * | 5/2003 |
| KR | 1020030038997 | A | | 5/2003 |
| KR | 1020030038999 | A | | 5/2003 |

* cited by examiner

【Figure 1】
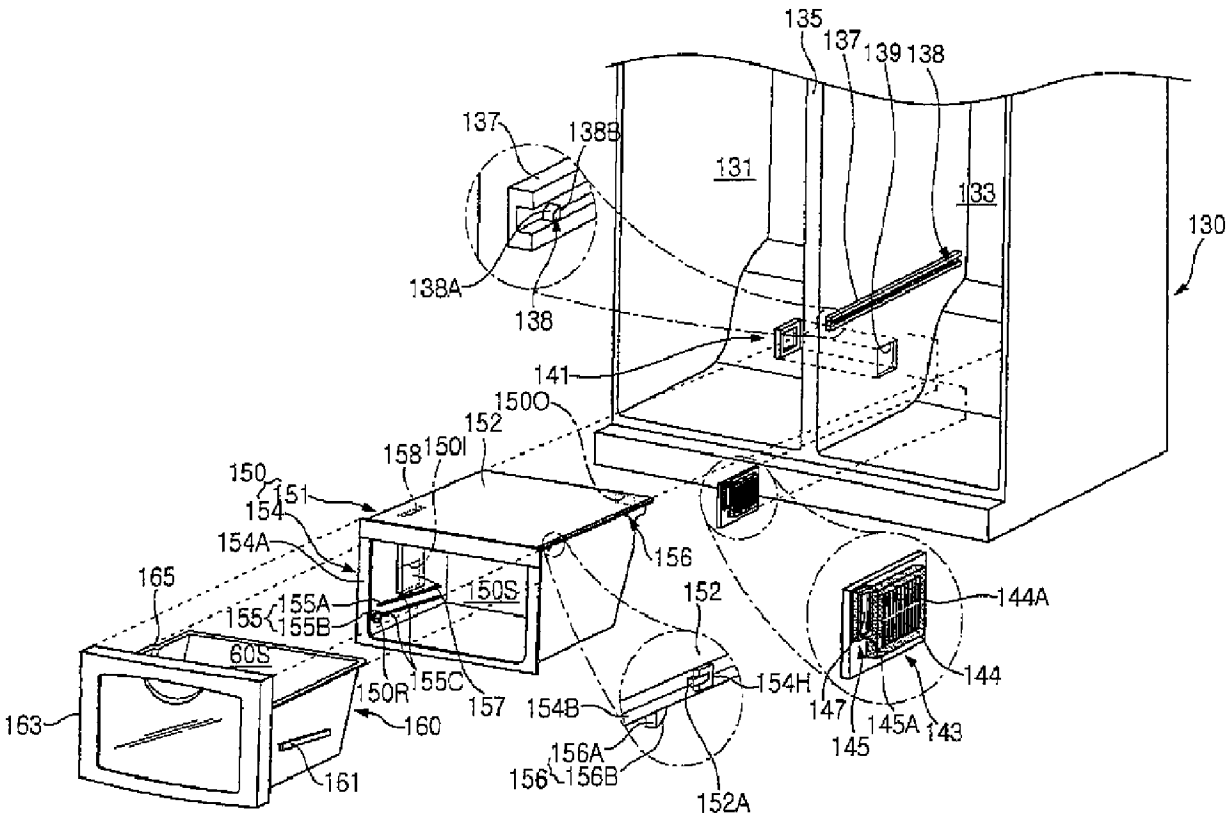

【Figure 2】
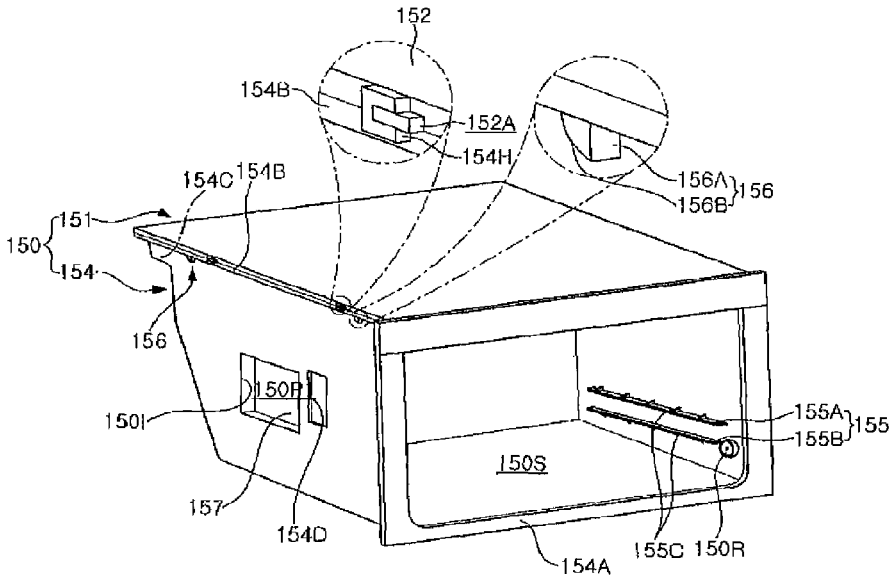

【Figure 3】
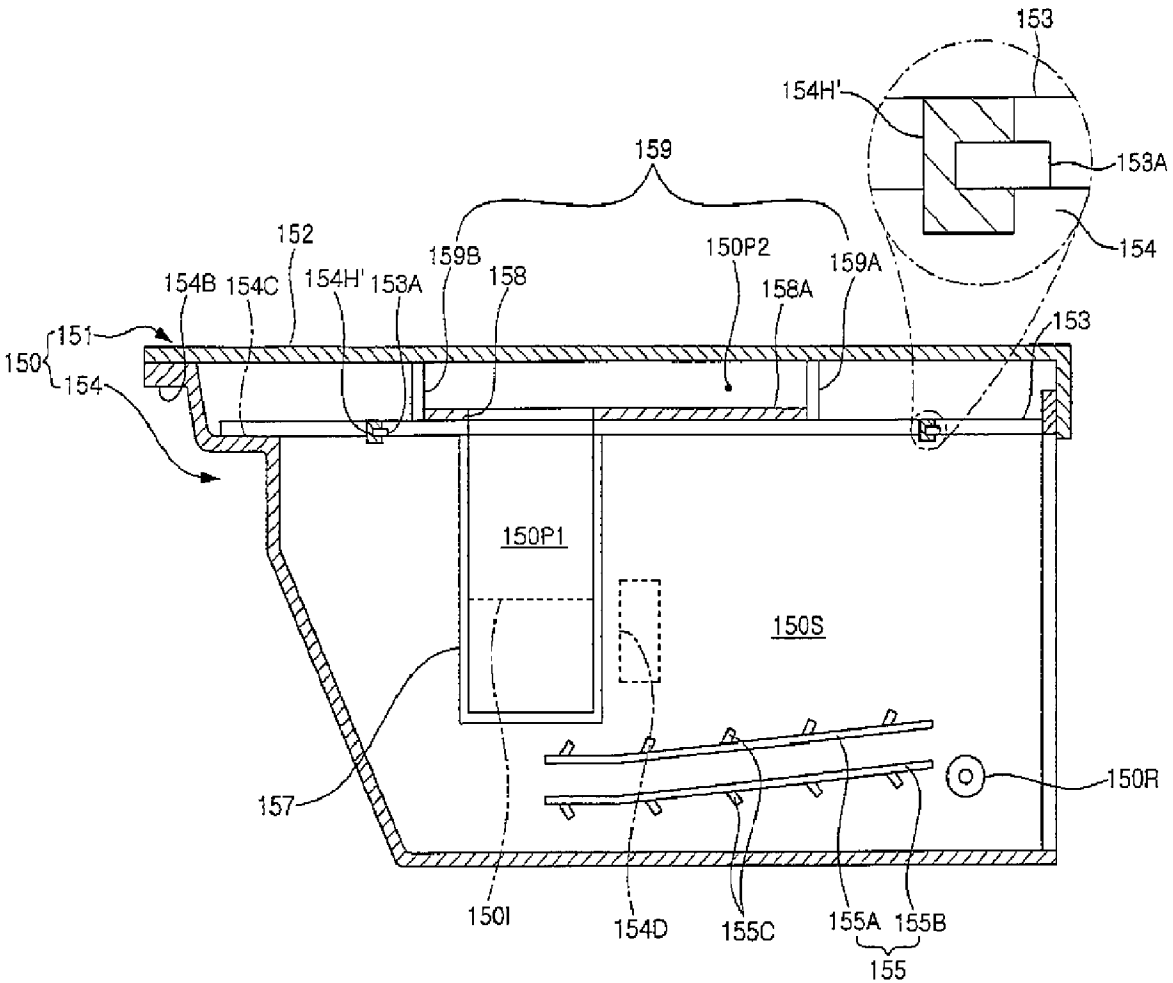

【Figure 4】
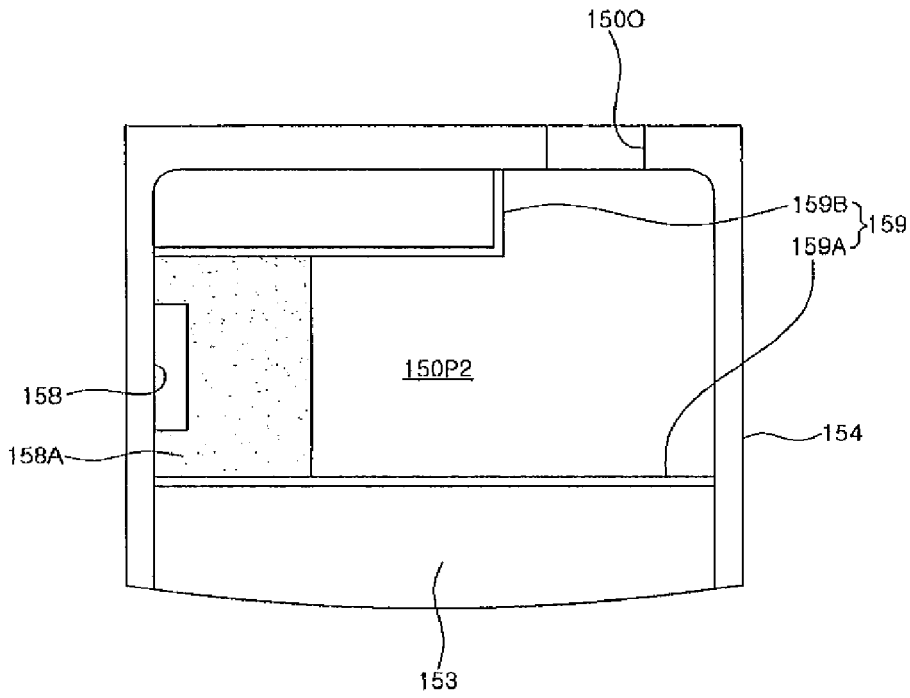

【Figure 5】
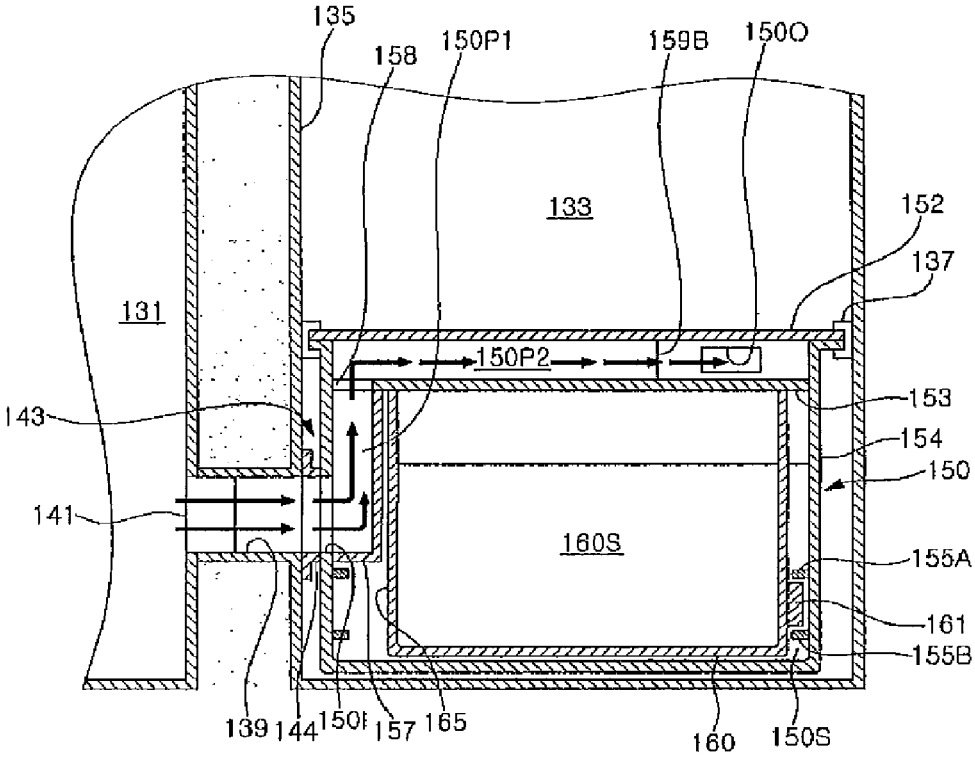

【Figure 6】
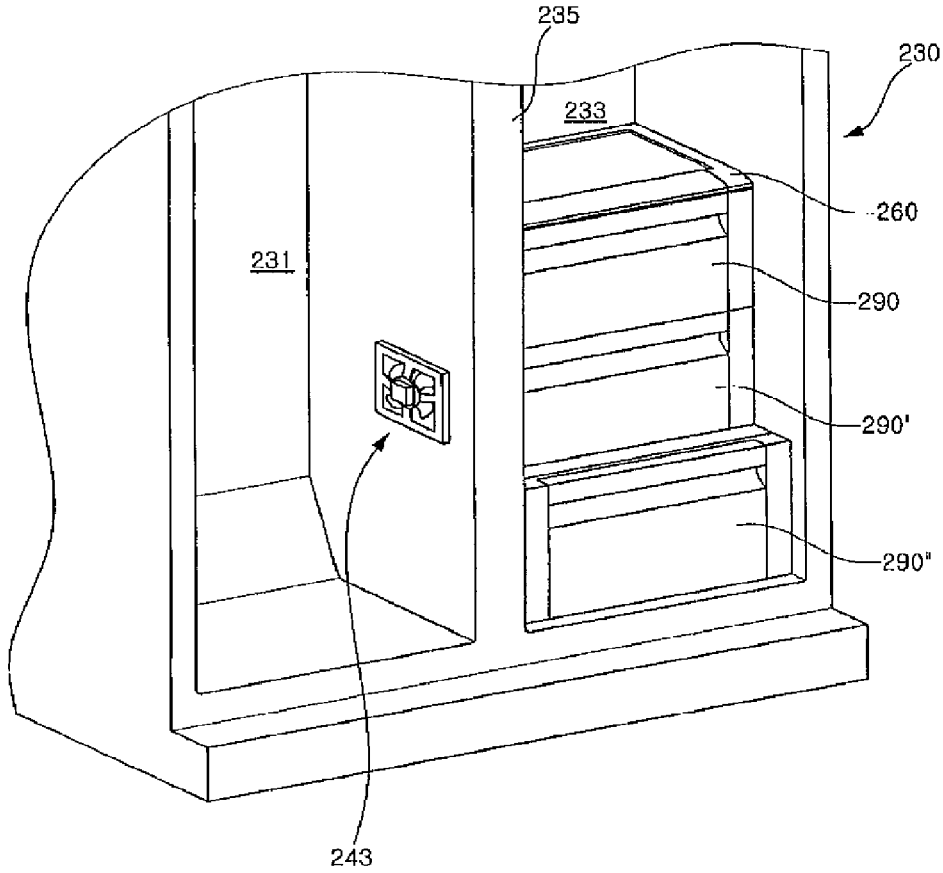

【Figure 7】
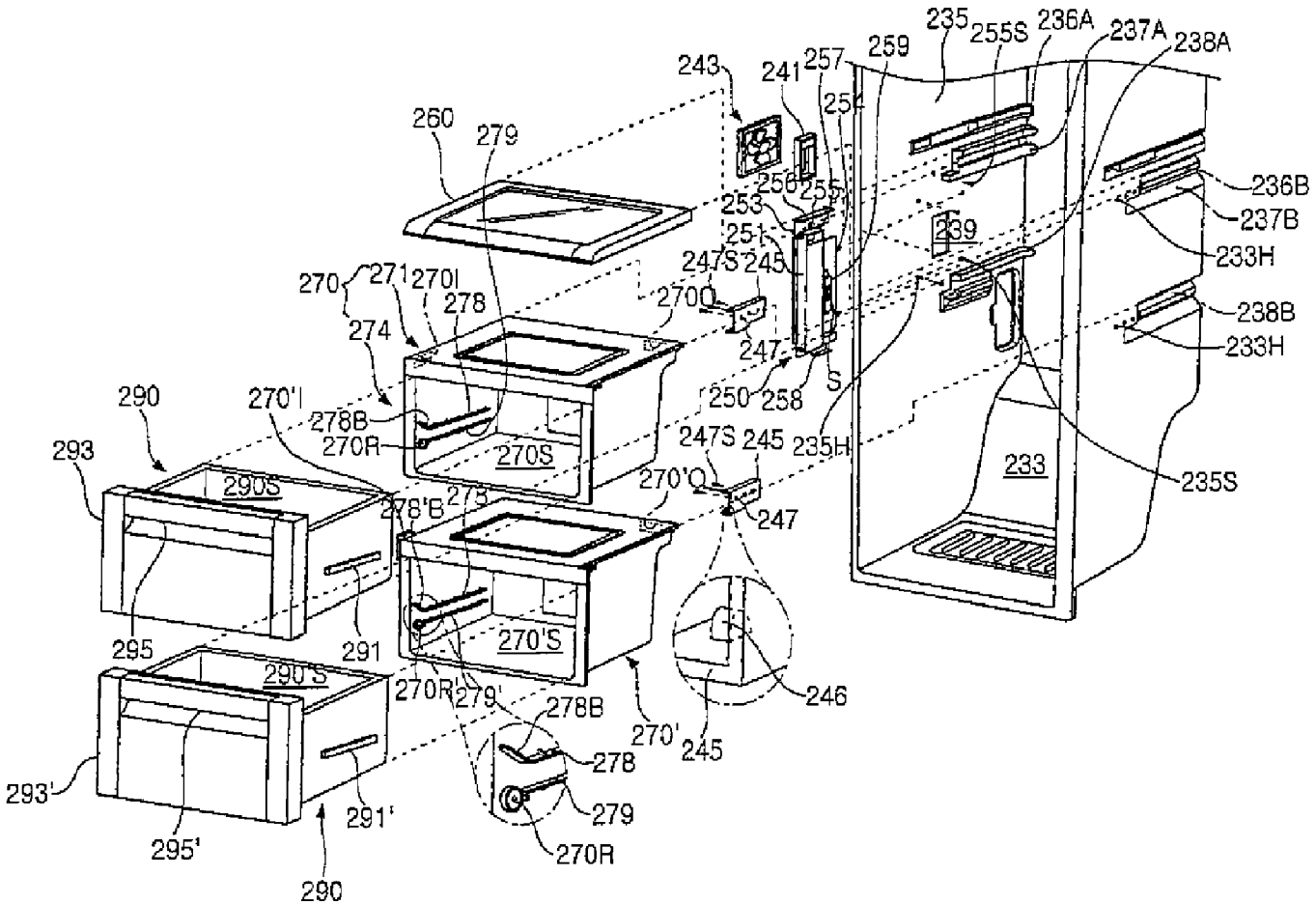

【Figure 8】
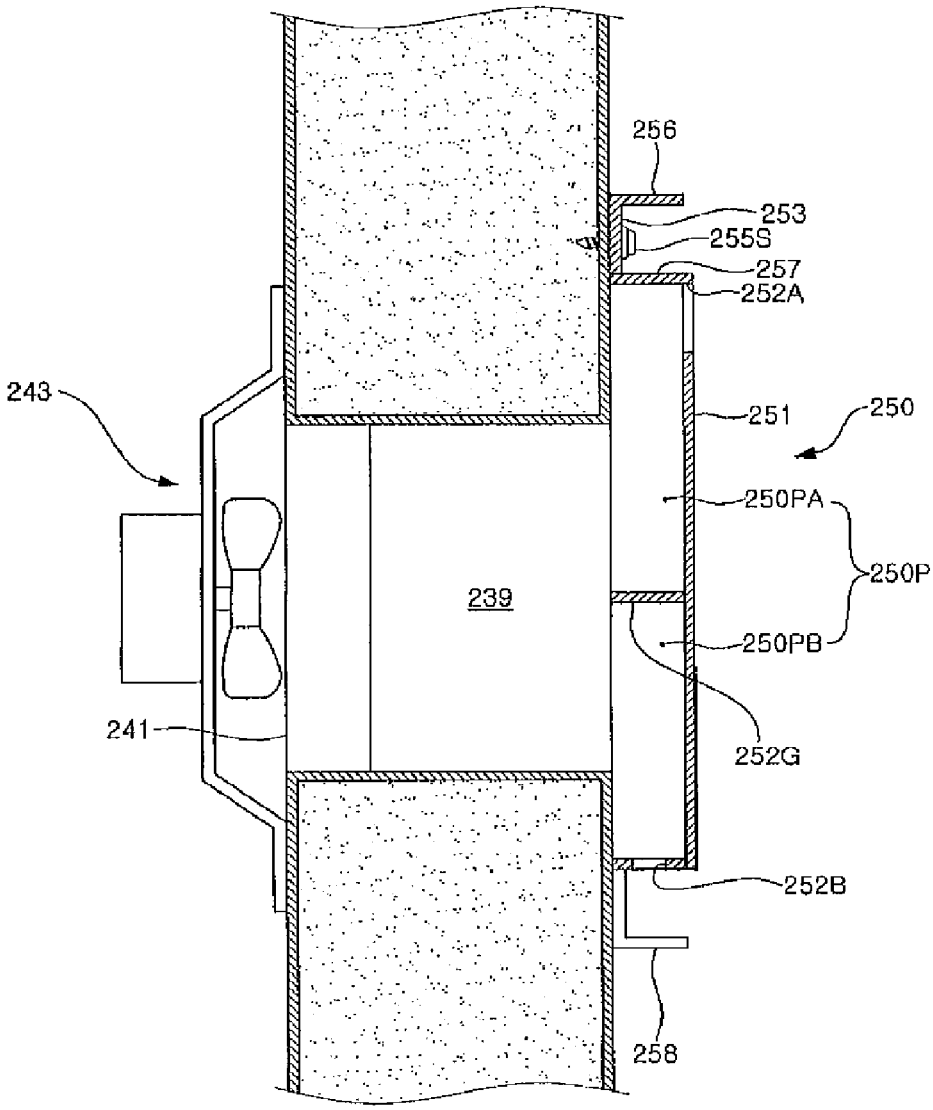

【Figure 9】
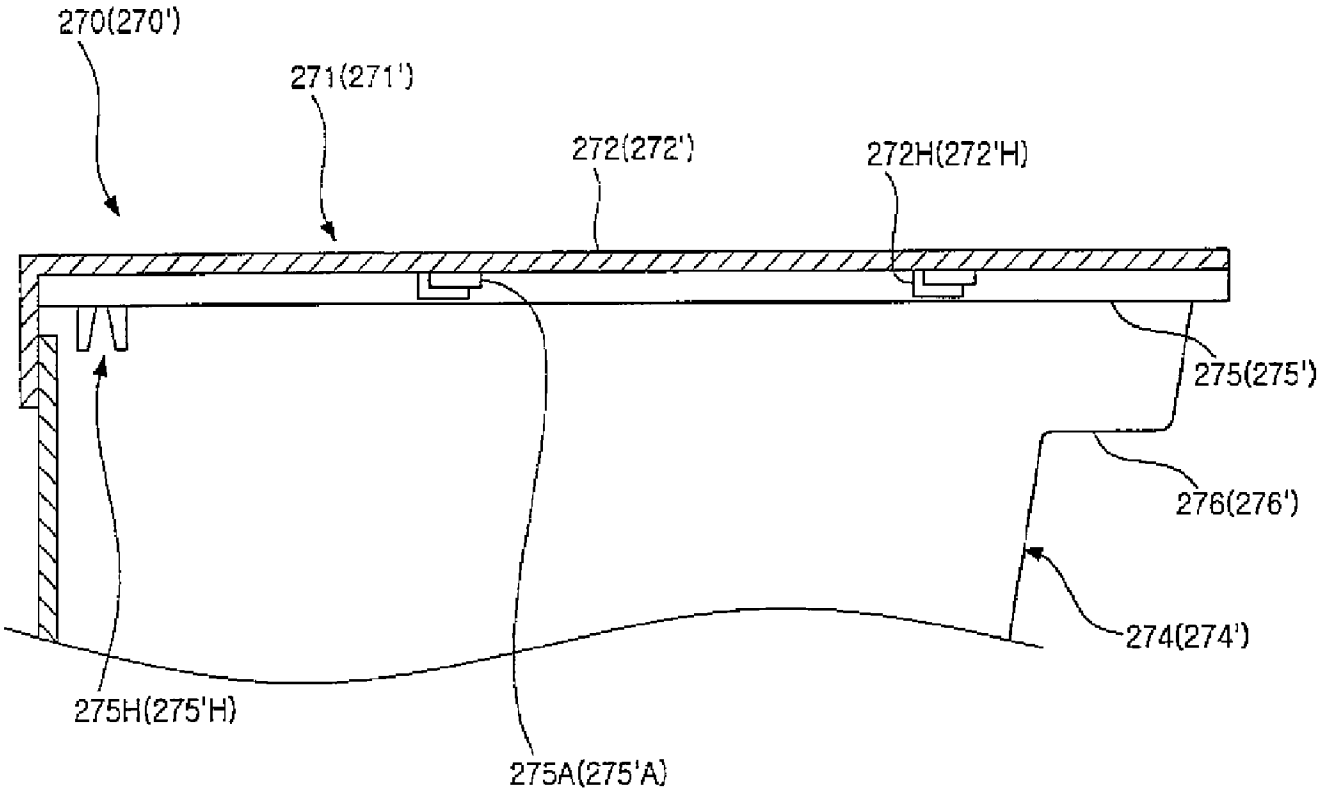

【Figure 10】
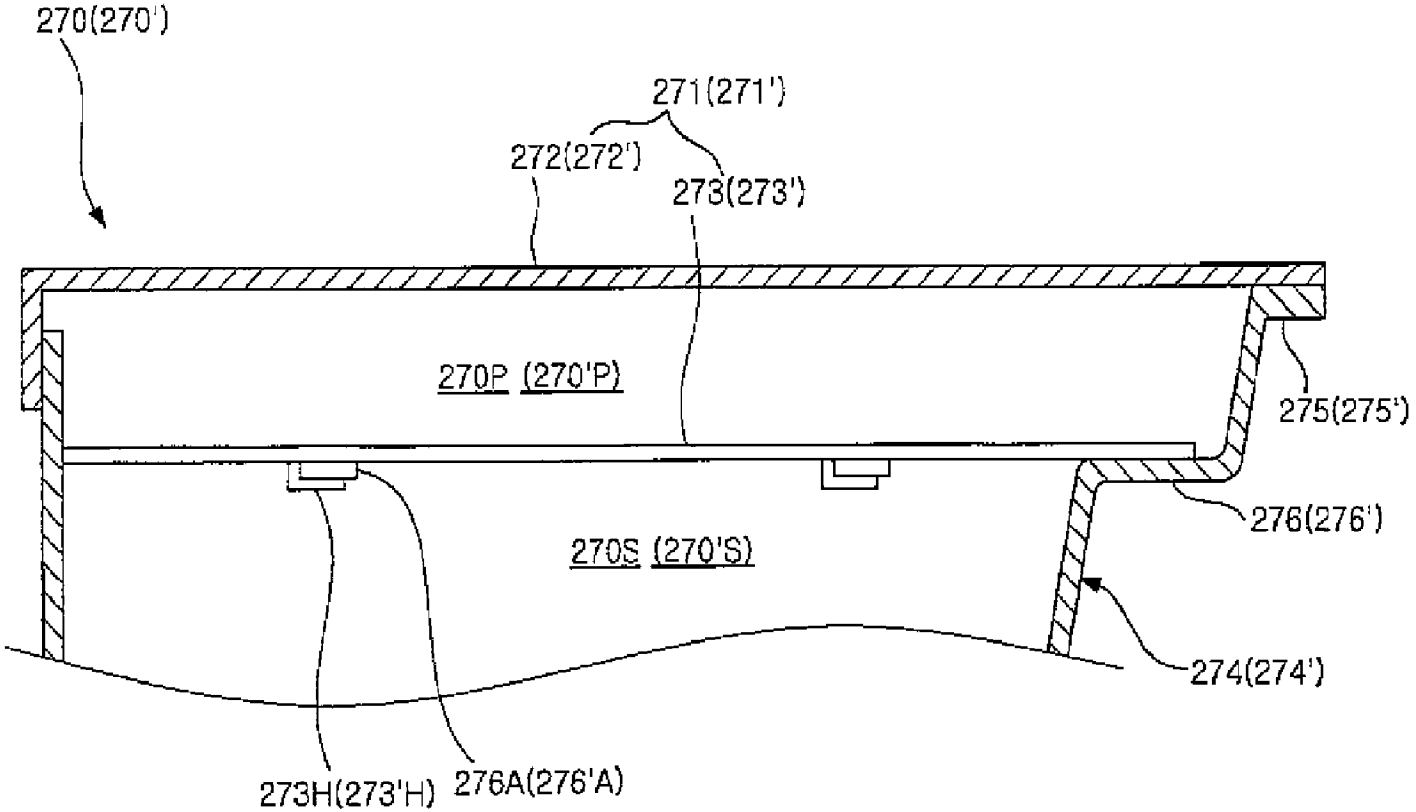

【Figure 11】
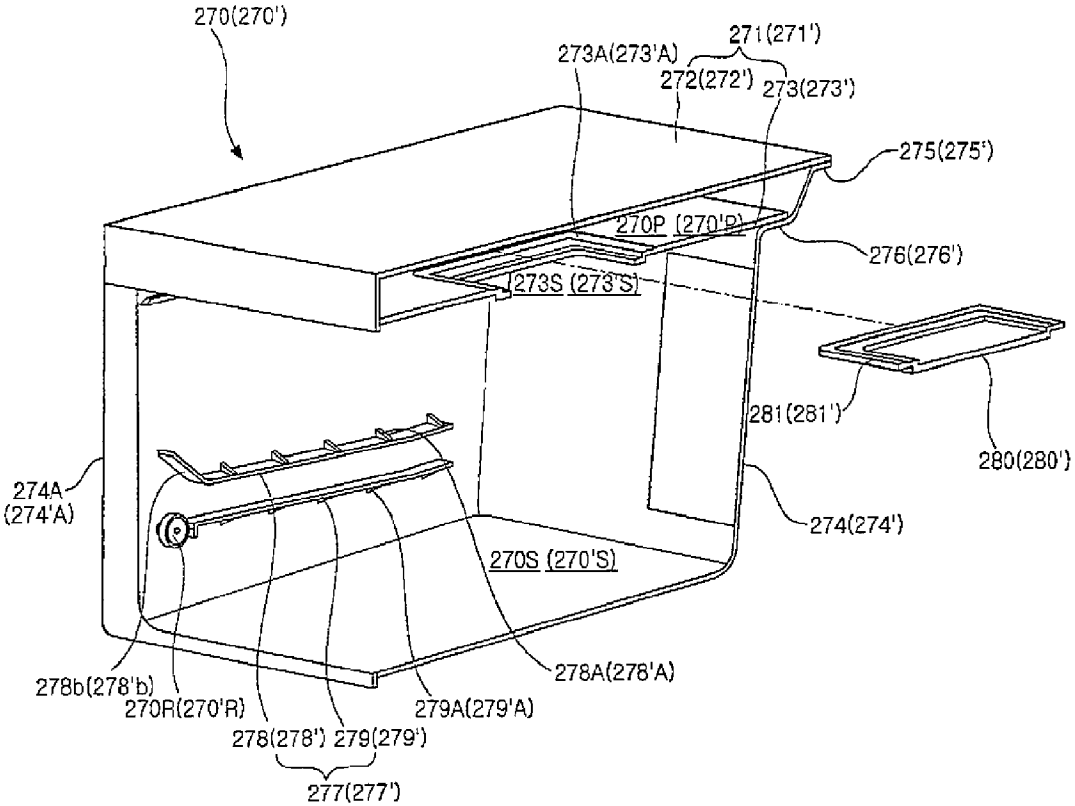

【Figure 12】
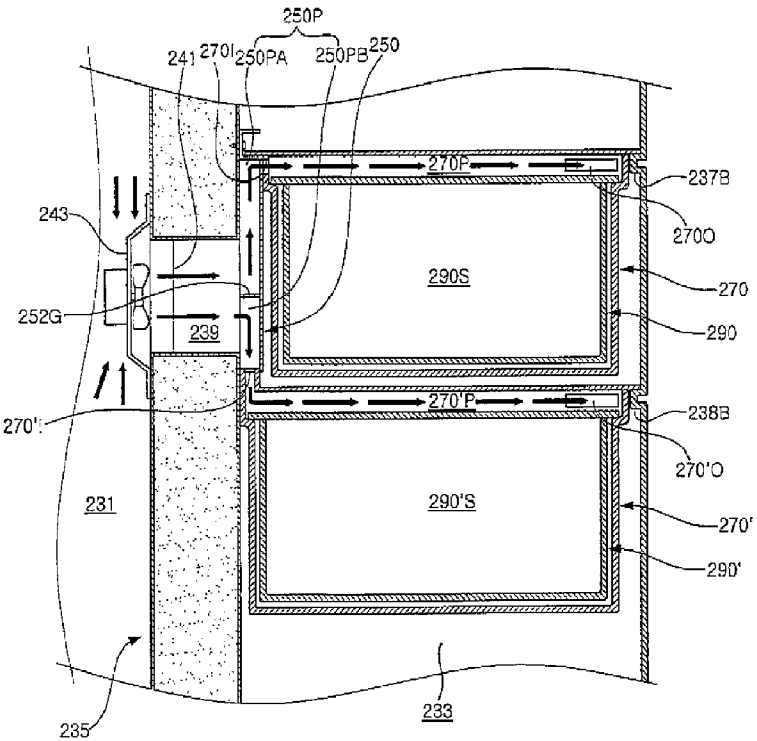

【Figure 13】
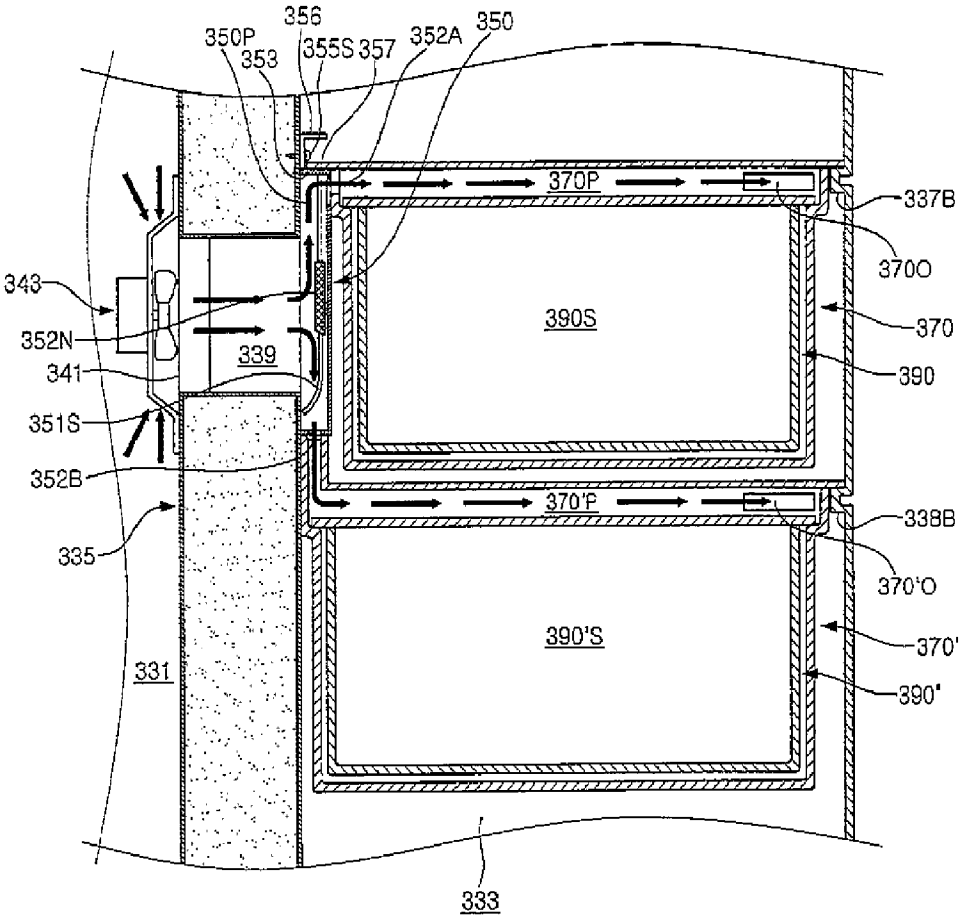

【Figure 14】
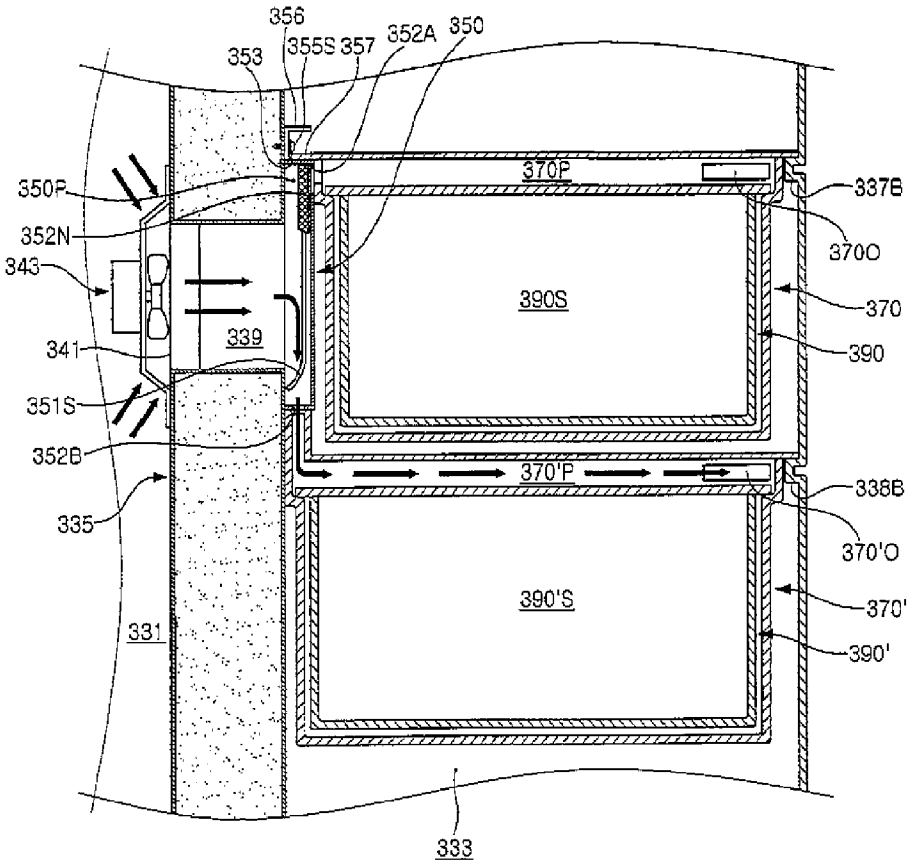

【Figure 15】
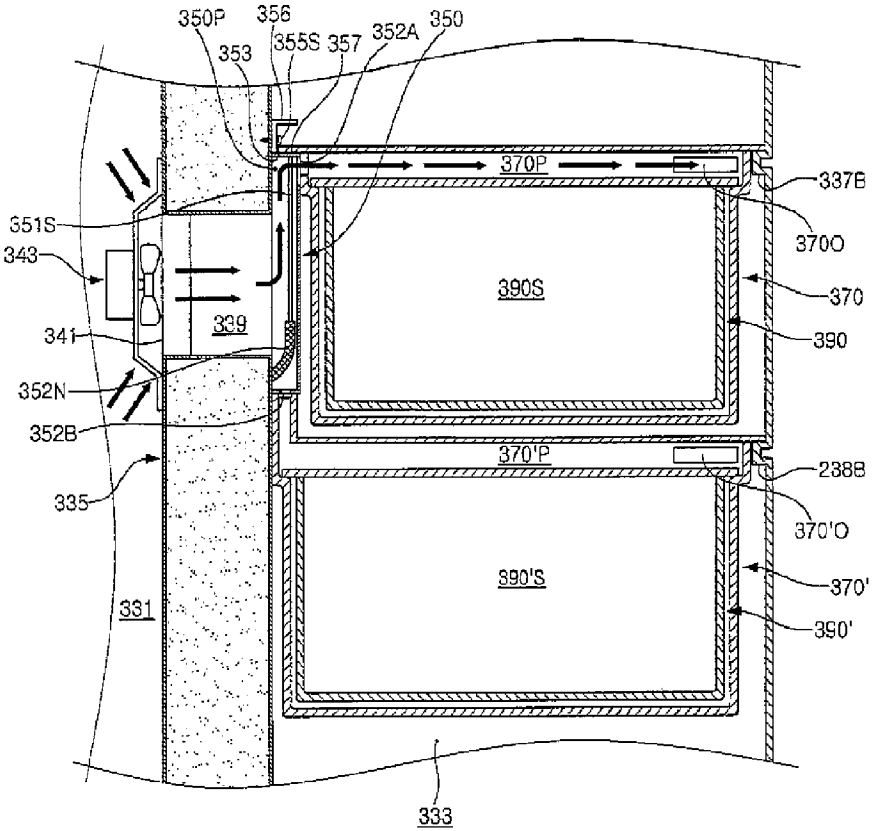

【Figure 16】
PRIOR ART
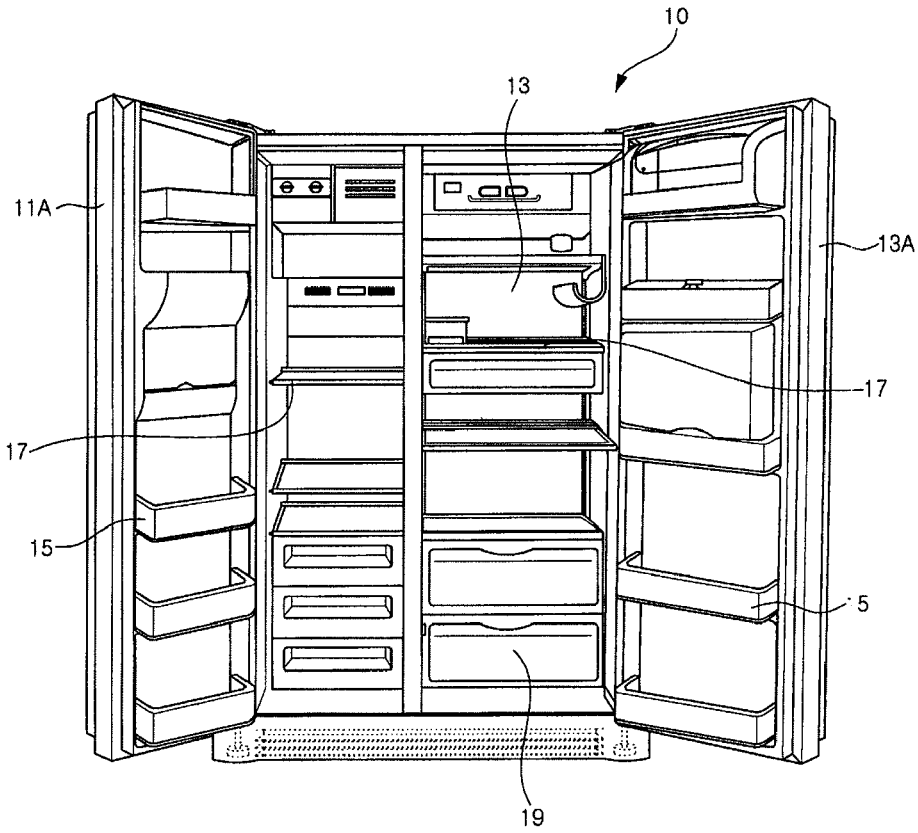

COOL AIR SUPPLY STRUCTURE OF STORAGE RECEPTACLE FOR REFRIGERATOR

TECHNICAL FIELD

The present invention relates to a refrigerator, and more particularly, to a cool air supply structure of a storage receptacle for a refrigerator to supply cool air into a storage receptacle for a refrigerator.

BACKGROUND ART

In a refrigerator main body, there is provided a storage space which is divided into a refrigerating chamber and a freezing chamber. The storage space is generally mounted with a plurality of storage receptacles for efficiently storing food.

FIG. 16 is a perspective view showing an interior of a refrigerator according to a prior art mounted with such storage receptacles.

As shown in the figure, a storage space in which food is accommodated is provided in a refrigerator main body 10. The storage space of the main body 10 is divided into left and right sides and thus includes a freezing chamber 11 and a refrigerating chamber 13. In addition, the main body 10 is provided with a freezing chamber door 11A and a refrigerating chamber door 13A for selectively opening and closing the freezing chamber 11 and the refrigerating chamber 13, respectively. The freezing and refrigerating chamber doors 11A and 13A are respectively installed on sides of the main body 10 so that the chamber doors pivot on their proximal ends for their distal ends to move back and forth of the main body 10.

In the meantime, on the rear of the freezing and refrigerating chamber doors 11A and 13A, there are provided a plurality of door baskets 15. The door baskets 15 are to accommodate food. The door baskets 15 are provided on the rear of the freezing and refrigerating chamber doors 11A and 13A to be vertically spaced apart from each other by predetermined intervals.

In addition, a plurality of shelves 17 are installed in the freezing and refrigerating chambers 11 and 13. The shelves 17 are detachably installed in the freezing and refrigerating chambers 11 and 13 and thus serve to divide the freezing and refrigerating chambers 11 and 13 into upper and lower parts, respectively. Food is seated on upper surfaces of the shelves 17.

In addition, a plurality of vegetable boxes 19 are withdrawably installed in a lower portion of the refrigerating chamber 13. An accommodation space for receiving food such as vegetable or fruit is provided in each vegetable box 19. The accommodation space of the vegetable box 19, which has an upper face generally opened, is covered with a bottom of another vegetable box positioned directly thereabove or a bottom of any one of the shelves 17.

Next, a process in which cool air circulates in the refrigerator, i.e., the freezing and refrigerating chambers will be described.

First, the cool air is generated by heat exchange with coolant flowing through an evaporator (not shown), which is provided in the main body 10 corresponding to the rear of the freezing chamber 11. The cool air is supplied to the freezing and refrigerating chambers 11 and 13 through cool air supply ports (not shown) respectively provided in upper portions of the freezing and refrigerating chambers 11 and 13.

In the meantime, the cool air supplied into the freezing and refrigerating chambers 11 and 13 circulates in the freezing and refrigerating chambers 11 and 13, thereby freezing or refrigerating the food accommodated therein. Further, the cool air freezing or refrigerating the food accommodated in the freezing and refrigerating chambers 11 and 13 flows toward the evaporator through cool air return ports (not shown) provided in lower portions of the freezing and refrigerating chambers 11 and 13, so that the circulation of cool air is performed in the refrigerator.

However, the refrigerator according to the above prior art has the following problems.

As described above, the accommodation space of the vegetable box 19 is covered with a bottom of another vegetable box positioned directly thereabove or a bottom of any one of the shelves 17, but is not completely made airtight thereby. Thus, since the cool air circulating in the refrigerating chamber 13 is delivered into the accommodation spaces of the vegetable boxes 19 and brought into contact with the food such as vegetable or fruit accommodated therein, there is concern that smell of other food stored in the refrigerating chamber 13 permeates into the food accommodated in the accommodation spaces of the vegetable boxes 19 or moisture in the food is evaporated and becomes dry.

In addition, as described above, the cool air circulating in the refrigerating chamber 13 is supplied through the cool air supply port provided in the upper portion of the refrigerating chamber 13 and then is returned through the cool air return port provided in the lower portion of the refrigerating chamber 13. However, since the vegetable box 19 is installed to the lower portion of the refrigerating chamber 13, the cool air delivered to the accommodation space of the vegetable box 19 refrigerates the food while circulating in the refrigerating chamber 13, thus has a relatively increased temperature. In the meantime, when an amount of the food stored in the refrigerating chamber 13 is a little, the cool air of low temperature flows downward in the refrigerating chamber 13 and is delivered into the accommodation spaces of the vegetable boxes 19. Thus, there is concern that the food accommodated in the accommodation spaces of the vegetable boxes 19 is weakly or excessively cooled.

DISCLOSURE

Technical Problem

The present invention is conceived to solve the aforementioned problems in the prior art. An object of the present invention is to provide a cool air supply structure of a storage receptacle for a refrigerator which is configured so that food accommodated in a storage receptacle can be stored to be fresher.

Another object of the present invention is to provide a cool air supply structure of a storage receptacle for a refrigerator which is configured so that cool air for indirectly cooling a plurality of storage receptacles is divided and supplied.

A further object of the present invention is to provide a cool air supply structure of a storage receptacle for a refrigerator which is configured so as to keep an amount of moisture contained in the food accommodated in a storage receptacle to a predetermined level.

Technical Solution

According to an aspect of the present invention for achieving the objects, there is provided a cool air supply structure of a storage receptacle for a refrigerator, comprising: one or more box casings detachably installed in a refrigerating chamber, each box casing having a mounting space and a channel through which cool air flows, the cool air being supplied from a cool air supply source through a cool air supply port formed in a side surface of the refrigerating chamber; and one or more storage receptacles, each storage receptacle being withdrawably installed in the mounting space, wherein food accommodated in an accommodation space provided in the storage receptacle is indirectly cooled by the cool air that flows through the channel.

The channel may comprise a first channel provided in a side surface of the box casing adjacent to the side surface of the refrigerating chamber to communicate with the cool air supply port, and a second channel provided in an upper portion of the box casing to communicate with the first channel.

The box casing may comprise an upper cover provided with the second channel and defining an upper external appearance of the box casing, and a lower casing fixed to the upper cover and defining both sides, rear and bottom external appearances of the box casing, the lower casing being provided with the first channel.

The first channel may be defined in the mounting space by an inner side surface of the box casing and an inner surface of a duct member fixed to the inner side surface of the box casing, and the second channel may be defined by a bottom surface of an upper plate, an upper surface of a lower plate and an inner upper end of both side surfaces and a rear surface of the lower casing, the upper and lower plates constituting the upper cover and being respectively fixed to the lower casing to be vertically spaced apart by a predetermined interval from each other.

The duct member may be formed in a hexahedral shape with an upper face and a side face facing the inner side surface of the lower casing opened, and may be fixed to the inner side surface of the lower casing for the cool air inlet and a communication hole to be positioned in the opened upper and side faces.

A duct seating portion, on which the duct member is seated in a state where the storage receptacle is mounted in the mounting space may be provided on a side surface of the storage receptacle.

The duct seating portion may be formed by stepping a side surface of the storage receptacle toward an inside of the accommodation space of the storage receptacle in correspondence with shape and thickness of the duct member.

A cool air inlet through which cool air is delivered to the first channel may be provided in the side surface of the lower casing, a cool air outlet through which cool air that flows through the second channel is discharged to the outside is provided in the rear surface of the lower casing, and the first and second channels communicate with each other through a communication hole provided in the lower plate.

An insulation for preventing dew condensation may be provided on the upper surface of the lower plate adjacent to the communication hole.

A cool air guide may be provided in the second channel, the cool air guide guiding the cool air, which is introduced through the communication hole and flows to second channel, to the cool air outlet.

The cool air guide may comprise a first cool air guide extending from a side end to the other side end of the upper cover corresponding to a side opposite to the cool air outlet with respect to the communication hole, and a second cool air guide extending from a side end of the upper cover corresponding to a side opposite to the first cool air guide with respect to the communication hole toward a side of the rear end of the upper cover adjacent to the cool air outlet.

The first and second cool air guides may be formed integrally with the lower plate.

There may be further comprise an auxiliary duct provided on the side surface of the refrigerating chamber adjacent to the cool air supply port, the auxiliary duct supplying the channel with the cool air delivered through the cool air supply port.

A cool air inlet may be provided in a side surface of the box casing, the cool air inlet communicating with the auxiliary duct and allowing cool air of a freezing chamber to be supplied to the channel, and a cool air outlet may be provided in a rear surface of the box casing, the cool air outlet allowing cool air flowing through the channel to be discharged to the outside.

There may be further comprise a temperature sensor for detecting an internal temperature of the mounting space of the box casing.

There may be further comprise a damper opening the cool air supply port when an internal temperature of the accommodation space of the storage receptacle detected by the temperature sensor is higher than a predetermined value, and closing the cool air supply port when an internal temperature of the accommodation space of the storage receptacle detected by the temperature sensor is lower than a predetermined value.

The temperature sensor may be mounted to a sensor mount, the sensor mount being provided in a side of an auxiliary duct provided on the side surface of the refrigerating chamber adjacent to the cool air supply port and supplying the channel with the cool air delivered through the cool air supply port, the temperature sensor detecting an internal temperature of the accommodation space of the storage receptacle through a temperature detection opening formed in a side surface of the box casing.

An insulation for preventing dew condensation may be provided on a surface of the auxiliary duct adjacent to the box casing.

There may be further comprising a guide means for guiding the storage receptacle taken in and out of the mounting space.

The guide means may comprise guide ribs respectively provided on both outer side surfaces of the storage receptacle, support rollers respectively provided on front ends of both inner side surfaces of the box casing to guide movement of the guide ribs in a process in which the storage receptacle is taken in and out of the mounting space, and guide rails respectively provided on both inner side surfaces of the box casing corresponding to rear portions of the support rollers.

The guide ribs may be formed to be inclined at a predetermined angle toward the front, and the guide rails ribs are formed to be upwardly inclined toward the front in correspondence with the guide ribs.

Each of the guide rails may comprise upper and lower guide rails vertically spaced apart by a predetermined interval, the guide rib sliding along a space there between, and the support rollers are provided on the front ends of both the inner side surfaces of the box casing corresponding to the front of the lower guide rails.

Reinforcing ribs for reinforcing the upper and lower guide rails may be provided on an upper surface of the upper guide rail and a bottom surface of the lower guide rail.

An inclination guide portion may be formed in a front end of the upper guide rail to be upwardly inclined toward the front at a relatively larger angle, thereby guiding the moving rail to slide along the lower guide rail in a process in which the storage receptacle is accommodated in the mounting space.

Meanwhile, the present invention provides a cool air supply structure of a storage receptacle for a refrigerator, comprising: a cool air duct installed to a side surface of a refrigerating chamber, the cool air duct being formed with a channel through which cool air flows, the cool air being supplied from a cool air supply source through a cool air supply port, the cool air supply port is formed in the side surface of the refrigerating chamber; and at least a pair of box casings divided from the refrigerating chamber, each of the box casings having a mounting space in which a storage receptacle is detachably installed and having a channel through which the cool air supplied from the cool air duct flows to indirectly cool food accommodated in an accommodation space of the storage receptacle.

The cool air duct may comprise a duct main body formed in a hexahedral shape with a longitudinal end surface opened, the channel being defined between all inner surface of the duct main body and the side surface of the refrigerating chamber, and a flange portion provided in an edge portion of the duct main body to be brought into close contact with the side surface of the refrigerating chamber.

The duct main body may be formed with at least of a pair of cool air outlets for supplying cool air to the respective channels of the box casings, and each of the box casings may be formed with a cool air inlet that communicates with the cool air outlet and is supplied with the cool air.

The flange portion may be formed with at least one through-hole which a fastener penetrates, the fastener being fastened to a fastening hole formed in the side surface of the refrigerating chamber, and the flange portion may be provided with at least one fastening piece, the fastening piece being inserted into a fastening slot formed in the side surface of the refrigerating chamber.

The cool air duct may be formed with a pair of cool air outlets for supplying the box casings with cool air, and each of the box casings may be formed with a cool air inlet) which communicates with the cool air outlet of the cool air duct and through which cool air flows to the channel, and a cool air outlets, through which the cool air that flows through the channel is discharged to the outside.

The cool air outlets of the box casings respectively may communicate with a cool air return port, which is formed in a side of the refrigerating chamber and into which the cool air circulating in the refrigerating chamber is introduced.

The cool air duct may be provided with a cool air guide for dividing the channel of the cool air duct into a predetermined number of sub-channels to divide cool air and supply it to the channels of the respective box casings.

The cool air duct may comprise a duct main body formed in a hexahedral shape with a longitudinal end surface opened, the channel being defined between an inner surface of the duct main body and the side surface of the refrigerating chamber, and a flange portion provided in an edge portion of the duct main body to be brought into close contact with the side surface of the refrigerating chamber; and the cool air guide is provided in the duct main body and divides the channel of the cool air duct into sub-channels to have the same area through which the sub-channels communicate with the cool air supply port.

The duct main body may have a first cool air outlet and a second cool air outlet formed in an upper portion of the longitudinal end surface and a bottom surface of the duct main body to supply the cool air to the channels of the box casings, respectively, and the cool air guide divides the channel of the cool air duct into upper and lower parts so that amounts of the cool air supplied to the channels of the box casings through the first and second cool air outlets are the same.

There may further comprise a cool air control means provided in a side of the cool air duct and controlling an amount of cool air supplied to the channel of the box casing.

The cool air duct may comprise a duct main body formed in a hexahedral shape with a longitudinal end surface opened, the channel being defined between an inner surface of the duct main body and the side surface of the refrigerating chamber, and a flange portion provided in an edge portion of the duct main body to be brought into close contact with the side surface of the refrigerating chamber; and the cool air control means selectively controls open areas of first and second cool air outlets respectively formed in an upper portion of the longitudinal end surface and a bottom surface of the duct main body.

The cool air control means may include a control knob moving along a guide slot formed in the duct main body.

The guide slot may be formed in the duct main body to have an upper end adjacent to the first cool air outlet and a lower end rounding toward the second cool air outlet, and the control knob may be formed of a flexible material.

There may further comprise a support means for supporting the box casing.

The support means may include support projections, which are provided on both side surfaces of the refrigerating chamber to extend in a fore and aft direction and support both side ends of the box casing.

The cool air duct may be positioned adjacent to a front end of the support projection that is provided on the side surface of the freezing chamber, and the cool air duct may be provided with a support piece, which is formed in a longitudinal direction of the support projection and substantially elongates a length of the support projection.

The cool air duct may comprise a duct main body formed in a hexahedral shape with a longitudinal end surface opened, the channel being defined between an inner surface of the duct main body and the barrier, and a flange portion provided in an edge portion of the duct main body to be brought into close contact with the side surface of the barrier; and the support piece is provided on any one of upper and lower ends of the flange portion.

There may further comprise a fixing means for fixing the box casing supported by the support means.

The fixing means may comprise a fixing protrusion provided on a fixing piece positioned adjacent to a front end of the support projection provided on the side surface of the refrigerating chamber corresponding to a side opposite to the cool air duct, and a fixing hook provided on a lower casing, the fixing protrusion being selectively inserted into the fixing hook, the lower casing being formed in a shape corresponding to both side surfaces and rear and bottom surfaces of the storage receptacle, both side surfaces and an upper end of a rear surface of the lower casing being fixed to a bottom surface of the box casing, the lower casing defining the mounting space which the storage receptacle is taken in and out of.

A humidity control material may be provided in a side of the box casing to maintain humidity in the accommodation space of the storage receptacle at a predetermined level.

The humidity control material may be formed by compressing porous polymer into a rectangular plate shape, the porous polymer absorbing moisture when relative humidity in the accommodation space of the storage receptacle is higher than a predetermined value and discharging moisture when relative humidity in the accommodation space of the storage receptacle is lower than a predetermined value.

The humidity control material may be installed in a mount opening formed in an inner portion of the box casing corresponding to a ceiling of the mounting space.

An edge of a bottom of the humidity control material may be supported on a supporting step, the supporting step being formed by downwardly stepping a portion of the box casing corresponding to an edge portion of the mount opening.

There may further comprise a temperature sensor for detecting an internal temperature of the accommodation space of the storage receptacle, and a damper for selectively opening and closing the cool air supply port, wherein the cool air supply port is opened by the damper only when an internal temperature of the accommodation space of the storage receptacle detected by the temperature sensor is higher than a predetermined value.

The temperature sensor may be installed to a sensor mount provided on a side of the cool air duct.

The temperature sensor may be brought into contact with a side of the box casing.

The damper may be installed in a barrier corresponding to the cool air supply port, the barrier dividing the refrigerating chamber and a freezing chamber from each other.

There may further comprise a fan assembly for causing cool air of the cool air supply source to flow toward the cool air supply port.

The fan assembly may be installed to a surface defining a surface of a freezing chamber side of a barrier corresponding to an opposite side of the cool air duct, the barrier dividing the refrigerating chamber and the freezing chamber from each other.

The fan assembly may comprise a mount frame fixed to the surface of the freezing chamber side of the barrier adjacent to the cool air supply port, a fan rotatably installed to the mount frame, and a drive motor for driving the fan.

There may further comprise a damper for selectively opening and closing the cool air supply port, wherein the fan assembly is driven only when the cool air supply port is opened by the damper.

There may further comprise a partition plate provided in an inner portion of the refrigerating chamber corresponding to a portion directly above the box casing, the partition plate for dividing a space, in which the storage receptacle, the cool air duct and the box casings are installed, from the refrigerating chamber.

Support projections for supporting the partition plate may be provided on both side surfaces of the refrigerating chamber to extend in a fore and aft direction.

The cool air duct may be positioned adjacent to a front end of the support projection provided on the side surface of the refrigerating chamber, and a support piece may be provided on a side of the cool air duct, the support piece being formed in a longitudinal direction of the support projection and substantially elongating a length of the support projection.

The partition plate may be one of shelves detachably installed in the refrigerating chamber.

Meanwhile, the present invention provides a cool air supply structure of a storage receptacle for a refrigerator, comprising: one or more mounting spaces divided from a refrigerating chamber, each of the mounting spaces being mounted with a storage receptacle withdrawably; and one or more channels allowing cool air to flow therethrough for indirectly cooling food accommodated in an accommodation space of the storage receptacle mounted in the mounting space, the cool air being supplied from a cool air supply source through a cool air supply port, the cool air supply port being formed in a side surface of the refrigerating chamber.

The mounting space may be provided in a box casing withdrawably installed in the refrigerating chamber, and the channel may be provided in an inner portion of the box casing corresponding to an upper portion of the mounting space.

There may further comprise a channel provided in a duct to deliver the cool air supplied from the cool air supply source through the cool air supply port to the channel of the box casing.

The cool air introduced through a cool air inlet and circulating in the channel of the box casing may be discharged to the outside through a cool air outlet formed in a side of the box casing, the cool air inlet being formed in the box casing to communicate with any one of a plurality of cool air outlets formed in the duct.

The channel of the duct may be divided into a predetermined number of sub-channels by a cool air guide provided in the duct, thereby dividing the cool air and supplying it to the channels of the box casings.

The cool air guide may divide the channel of the cool air duct into upper and lower parts so that amounts of the cool air respectively supplied to the channels of the box casings through a plurality of cool air outlets formed in the duct are the same.

Amounts of the cool air respectively supplied to the channels of the box casings through the channel of the duct may be controlled by a cool air control means.

The cool air control means may include a control knob, which moves along a guide slot formed in the duct to control open areas of a plurality of cool air outlets formed in the duct.

A humidity control material provided in a ceiling of the mounting space may cause humidity in the accommodation space of the storage receptacle to be maintained at a predetermined level.

The humidity control material may be formed by compressing porous polymer into a rectangular plate shape, the porous polymer absorbing moisture when relative humidity in the accommodation space of the storage receptacle is higher than a predetermined value and discharging moisture when relative humidity in the accommodation space of the storage receptacle is lower than a predetermined value.

The cool air supply port that supplies cool air to the channel of the box casing may be opened by a damper only when an internal temperature of the accommodation space of the storage receptacle detected by the temperature sensor is higher than a predetermined value.

A fan assembly may be driven and the cool air of the cool air supply source flows toward the cool air supply port only when the cool air supply port is opened by the damper.

A portion of the refrigerating chamber in which the box casing may be installed is divided from the refrigerating chamber by a partition plate detachably installed in a portion above the box casing.

The partition plate may be one of shelves detachably installed in the refrigerating chamber.

The storage receptacle may be guided by a guide means in a process in which the storage receptacle is taken in and out of the mounting space.

The guide means may comprise guide ribs respectively provided on both outer side surfaces of the storage receptacle, support rollers respectively provided on front ends of both inner side surfaces of the box casing to guide movement of the guide ribs in a process in which the storage receptacle is taken in and out of the mounting space, and guide rails respectively provided on both inner side surfaces of the box casing corresponding to rear portions of the support rollers.

The guide ribs may be formed to be inclined at a predetermined angle toward the front, and the guide rails ribs are formed to be upwardly inclined toward the front in correspondence with the guide ribs.

Each of the guide rails may comprise upper and lower guide rails vertically spaced apart by a predetermined interval, the guide rib sliding along a space therebetween, and the support rollers may be provided on the front ends of both the inner side surfaces of the box casing corresponding to the front of the lower guide rails.

Reinforcing ribs for reinforcing the upper and lower guide rails may be provided on an upper surface of the upper guide rail and a bottom surface of the lower guide rail.

An inclination guide portion may be formed in a front end of the upper guide rail to be upwardly inclined toward the front at a relatively larger angle, thereby guiding the moving rail to slide along the lower guide rail in a process in which the storage receptacle may be accommodated in the mounting space.

Meanwhile, the present invention provides there is a refrigerator comprising the cool air supply structure of a storage receptacle as claimed in any one of claims 1 to 79.

Advantageous Effects

According to the present invention, it can be expected as advantageous effects that the food accommodated in a plurality of storage receptacles can be stored to be fresher by indirectly cooling the food and simultaneously the supply of cool air can be controlled depending on the use or not of the storage receptacles.

DESCRIPTION OF DRAWINGS

FIG. 1 is an exploded perspective view showing a first embodiment of a cool air supply structure of a storage receptacle for a refrigerator according to the present invention;

FIG. 2 is a perspective view showing a box casing of the first embodiment of the present invention;

FIG. 3 is a sectional side view showing the box casing of the first embodiment of the present invention with a side cut away;

FIG. 4 is a sectional plan view showing the first embodiment of the present invention with an upper portion cut away;

FIG. 5 is a sectional side view showing a flow state of cool air supplied according to the first embodiment of the present invention;

FIG. 6 is a perspective view showing a second embodiment of the cool air supply structure of a storage receptacle for a refrigerator according to the present invention;

FIG. 7 is an exploded perspective view of the second embodiment of the present invention as viewed from another angle;

FIG. 8 is a sectional side view showing a major portion of the second embodiment of the present invention;

FIG. 9 is a side view showing a major portion of a box casing of the second embodiment of the present invention;

FIG. 10 is a sectional side view showing a major portion of the box casing of the second embodiment of the present invention;

FIG. 11 is a partially cutaway perspective view showing the box casing of the second embodiment of the present invention;

FIG. 12 is a sectional side view showing a flow state of cool air supplied according to the second embodiment of the present invention;

FIG. 13 is a sectional side view showing a major portion of a third embodiment of the cool air supply structure of a storage receptacle for a refrigerator according to the present invention;

FIGS. 14 and 15 are sectional side views showing a process of controlling cool air according to the third embodiment of the present invention; and FIG. 16 is a perspective view showing an interior of a refrigerator according to a prior art.

BEST MODE

Figure 5A:
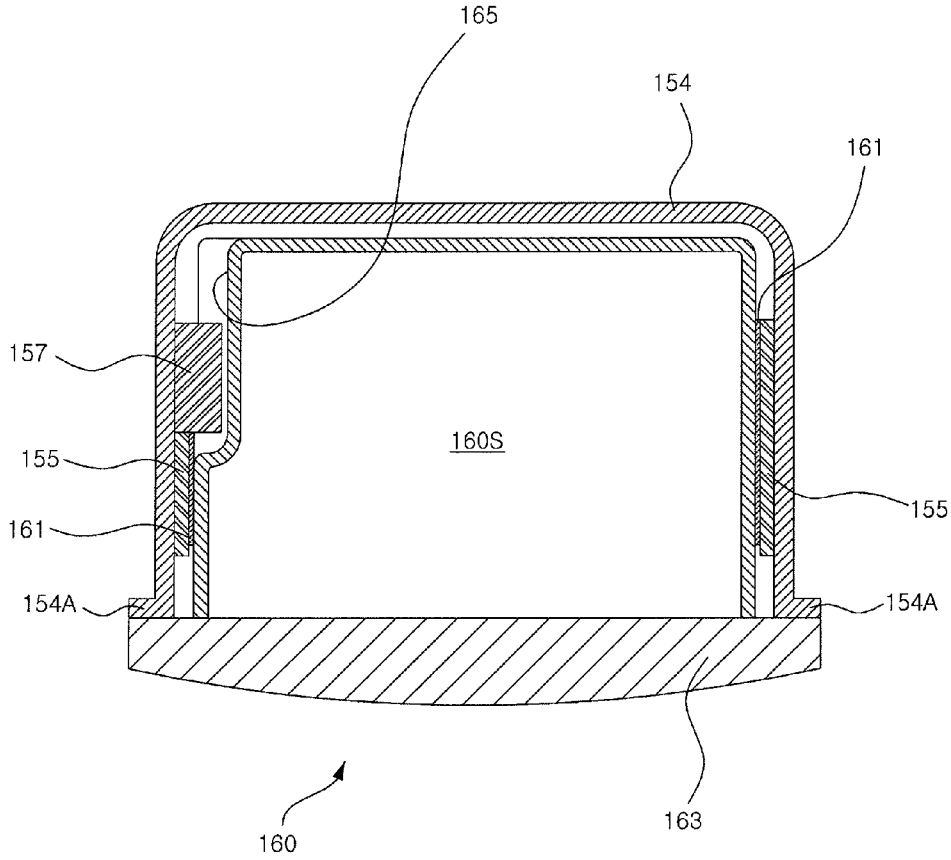
FIG. 5*a* is a cross sectional view of the storage receptacle and the box casing showing the stepped configuration of the storage receptacle sidewall.

Hereinafter, a preferred embodiment of a cool air supply structure of a storage receptacle for a refrigerator according to the present invention will be described in detail with reference to the accompanying drawings.

FIG. 1 is an exploded perspective view showing a first embodiment of a cool air supply structure of a storage receptacle for a refrigerator according to the present invention, FIG. 2 is a perspective view showing a box casing of the first embodiment of the present invention, FIG. 3 is a sectional side view showing the box casing of the first embodiment of the present invention with a side cut away, and FIG. 4 is a sectional plan view showing the first embodiment of the present invention with an upper portion cut away.

As shown in the figure, a storage space is provided within the refrigerator main body 130. Such a storage space comprises a freezing chamber 131 and a refrigerating chamber 133 which are divided from each other from side to side by a barrier 135 provided in the main body 130. The freezing and refrigerating chambers 131 and 133 are provided with cool air supply ports (not shown), through which cool air subjected to heat transfer in an evaporator (not shown) is supplied, and cool air return ports (not shown), through which the cool air which has circulated in the chambers flows to the evaporator.

Guide rails 137 are provided on lower portions of both side surfaces of the refrigerating chamber 133, respectively. The guide rails 137 of the refrigerating chamber 133 are to guide a box casing 150 which is accommodated in the refrigerating chamber 133 and will be described below, The respective guide rails 137 of the refrigerating chamber 133, which have U-shaped cross sections opened to the directions facing each other, are formed on both the side surfaces of the refrigerating chamber 133 to extend in the fore and aft direction.

As enlargedly shown in FIG. 1, fixing protrusions 138 are respectively provided on front and rear ends of an upper surface of a lower plate of each guide rail 137 of the refrigerating chamber 133. The fixing protrusions 138 are to fix the box casing 150 mounted to the refrigerating chamber 133 at a predetermined position. The fixing protrusions 138 respectively protrude upward by a predetermined height at the front and rear ends of the upper surface of the lower plate of each guide rail 137 of the refrigerating chamber 133.

At this time, the front of each fixing protrusion 138 is provided with a guide surface 138A that extends rearward to be inclined upward with respect to the upper surface of the lower plate of the guide rail 137 of the refrigerating chamber 133. The rear of the fixing protrusion 138 is also provided with a fixing surface 138B that extends upward to be perpendicular to the upper surface of the lower plate of the guide rail 137 of the refrigerating chamber 133.

Also, the barrier 135 is formed with a cool air supply port 139. The cool air supply port 139 functions as a passage through which the cool air circulating in the freezing chamber 131 is delivered to auxiliary duct 143. Although the cool air supply port 139 is formed in a rectangular shape in the illustrated embodiment, the shape of the cool air supply port 139 is not limited thereto.

In addition, a damper 141 is provided in the barrier 135 corresponding to the cool air supply port 139. The damper 141 comprises a baffle rotatably installed and a drive motor for rotating the baffle. Since the configuration of such a damper 141 has been well known, the detailed descriptions thereof will be omitted.

The damper 141 serves to selectively open and close the cool air supply port 139 according to an internal temperature of an accommodation space 160S of a vegetable box 160, which will be described below. That is, the damper 141 opens the cool air supply port 139 only when the internal temperature of the accommodation space 160S of the vegetable box 160 is higher than a predetermined value.

An auxiliary duct 143 is provided on a surface of the barrier 135 which defines a side surface of the refrigerating chamber 133. The auxiliary duct 143 is formed in a flat hexahedral shape with a face generally opened. The auxiliary duct 143 serves to cause the cool air supply port 139 to communicate with a cool air inlet 150I, which will be described below. Although not shown, the auxiliary duct 143 may be fixed to the barrier 135 with additional fasteners or the like.

In addition, the auxiliary duct 143 is provided with a plurality of communication openings 144. The communication openings 144 are formed by cutting a surface of the auxiliary duct 143 in a lattice shape. The communication openings 144 are brought into close contact with the left side of the box casing 150 adjacent to the cool air inlet 150I in the figure.

An insulation 144A is provided on a surface of the auxiliary duct 143 corresponding to an edge portion of the communication openings 144. The insulation 144A is to prevent dew condensation caused from the cool air of the freezing chamber 131, which is delivered through the cool air supply port 139 and has a relatively low temperature.

In addition, the auxiliary duct 143 is provided with a sensor mount 145. The sensor mount 145 is formed by cutting off a portion of the auxiliary duct 143. A surface of the sensor mount 145 is positioned in correspondence with a temperature detection opening 154*d* of the box casing 150, with the auxiliary duct 143 fixed to the surface of the barrier 135.

The sensor mount 145 is mounted with a temperature sensor 147. The temperature sensor 147 serves to detect the internal temperature of the accommodation space 160S of the vegetable box 160. That is, the temperature sensor 147 substantially detects the internal temperature of the accommodation space 160S of the vegetable box 160 by detecting a temperature of the box easing 150 in close contact with the sensor mount 145 in a state where the temperature sensor 147 is installed to the sensor mount 145.

An insulation 145A is provided on the other surface of the sensor mount 145. The insulation 149 serves to prevent dew condensation from occurring on the sensor mount 145, like the insulation 144A of the communication openings 144. Also, the insulation 145A is in close contact with the left side of the box casing 150 in the figure adjacent to the temperature detection opening 154*d*, whereby the insulation 145A also serves to causes the temperature sensor 147 to more accurately detect the internal temperature of the accommodation space 160S of the vegetable box 160.

In the meantime, the box casing 150 is withdrawably installed in a lower portion of the refrigerating chamber 133. Hereinafter, the lower portion of the refrigerating chamber 133 in which the box casing 150 is installed is referred to as a vegetable chamber for convenience. Although in the illustrated embodiment, the single box casing 150 is installed in the vegetable chamber, two or more box casings can be installed. However, in a case where the plurality of box casings are installed, there are provided the cool air supply ports 139 as many as the number of the box casings.

A mounting space 150S is provided in the box casing 150. The vegetable box 160 is withdrawably installed in the mounting space 150S of the box casing 150. The box casing 150 serves to indirectly cool the food accommodated in the accommodation space 160S of the vegetable box 160. The box casing 150 comprises an upper cover 151 and a lower casing 154.

As shown in FIG. 3, the upper cover 151 comprises an upper plate 152 and a lower plate 153. The upper plate 152 defines an external appearance of an upper surface and a front upper end surface of the box casing 150. The lower plate 153 is installed in the lower casing 154 below the upper plate 152. Each of the upper plate 152 and the lower plate 153 is formed in a rectangular plate shape, wherein the lower plate 153 has a relatively small fore-and-aft length and lateral width as compared with the upper plate 152.

The lower casing 154 is formed in a generally hexahedral shape with front and upper portions generally opened. There is provided a contact flange 154A which extends respectively laterally and downwardly from front ends of both side surfaces and a bottom surface of the lower casing 154. The contact flange 154A is to prevent the vegetable box 160 from being completely inserted into the mounting space 150S.

Referring to FIGS. 2 and 3, a support rib 154B is provided on upper ends of both the side surfaces and a rear surface of the lower casing 154. The support rib 154B is formed by causing the upper ends of both the side surfaces of the lower casing 154 to extend outwardly. A bottom edge surface of the upper plate 152 is supported on the upper surface of the support rib 154B.

In addition, a support step portion 154*c* is provided in the rear of the lower casing 154. The support step portion 154*c* is formed by rearward stepping an upper end of the rear of the lower casing 154. A rear end of a bottom surface of the lower plate 153 is supported on the support step portion 154*c* of the lower casing 154.

The temperature detection opening 154*d* is provided in a side of the left side surface of the lower casing 154 in the figure. The temperature detection opening 154*d* allows the temperature sensor 147 to more accurately detect the internal temperature of the accommodation space 160S of the vegetable box 160. To this end, the temperature detection opening 154*d* causes the mounting space 150S to communicate with the sensor mount 145 mounted with the temperature sensor 147.

In addition, support rollers 150*r* are respectively provided on front ends of both the inner side surfaces of the lower casing 154. Also, guide rails 155 are respectively provided at positions corresponding to rear portions of the support rollers 150*r* on both the inner side surfaces of the lower casing 154. The support rollers 150*r* and the guide rails 155 serve to guide the vegetable box 160 taken in and out of the mounting space 150S.

Each of the guide rails 155 comprises an upper guide rail 155A and a lower guide rail 155B which are formed to be upwardly inclined toward the front at a predetermined angle, i.e., at the same angle as a guide rib 161. The upper and lower guide rails 155A and 155B are vertically spaced apart by a predetermined distance from each other. A plurality of reinforcing ribs 155*c* are provided on an upper surface of the upper guide rail 155A and a bottom surface of the lower guide rail 155B. The reinforcing ribs 155*c* extend to be upwardly or downwardly inclined at a predetermined angle from the upper surface of the upper guide rail 155A and the bottom surface of the lower guide rail 155B, thereby serving to reinforce the upper and lower guide rails 155A and 155B.

Also, on each side end of the upper and lower plates 152 and 153, there are respectively provided catching protrusions 152A or 153A in a pair. The pair of catching protrusions 152A or 153A are provided at a predetermined interval on each side end of the upper and lower plates 152 and 153. The respective catching protrusions 152A and 153A are formed to have a thickness relatively smaller than that of the upper and lower plates 152 and 153.

In addition, catching hooks 154H and 154H' are respectively provided on both the side surfaces of the lower casing 154. The catching protrusions 152A and 153A are inserted into the catching hooks 154H and 154H' in a state where the upper and lower plates 152 and 153 are respectively supported on the upper ends of both the side surfaces and the support step portion 154*c* of the lower casing 154. To this end, the respective catching hooks 154H and 154H' are formed in a U-shape opened forward. In addition, since the catching protrusions 152A and 153A are inserted into the catching hooks 154H and 154H', the upper cover 151, i.e., the upper and lower plates 152 and 153, are fixed to the lower casing 154.

Among the catching hooks 154H and 154H', the catching hooks 154H into which the catching protrusions 152A of the upper plate 152 are inserted are provided on front and rear ends of outer side surfaces of the support rib 154B. Also, among the catching hooks 154H and 154H', the catching protrusions 154H' into which the catching protrusions 153A of the lower plate 153 are inserted are provided on upper front and rear ends of both the inner side surfaces of the lower casing 154.

A pair of support protrusions 156 are provided on a bottom surface of the support rib 154B corresponding to each of the upper ends of both the side surfaces of the lower casing 154. The support protrusions 156 are to fix the box casing 150 mounted to the refrigerating chamber 133 to a predetermined position. The support protrusions 156 protrude downward at front ends of the bottom surface of the support rib 154B.

Further, in the front of each support protrusion 156, there is provided a support surface 156A that extends downward perpendicular to the bottom surface of the support rib 154B. In the rear of the support protrusion 156, there is provided a sliding surface 156B that extends rearward to be inclined upwardly with respect to the bottom surface of the support rib 154B.

In a state where the box casing 150 is mounted to the refrigerating chamber 133, the support protrusions 156 go over the fixing protrusions 138. At this time, in a state where the sliding surfaces 156B of the support protrusions 156 are brought into close contact with the guide surfaces 138A of the fixing protrusions 138, the sliding surfaces 156B slide along the guide surfaces 138A. Then, in a state where the support protrusions 156 have completely gone over the fixing protrusions 138, the fixing surfaces 138B of the fixing protrusions 138 and the support surfaces 156A of the support protrusions 156 are brought into close contact with each other, whereby the box casing 150 is mounted to the refrigerating chamber 133 and is not taken out from such a state inadvertently.

In the meantime, the cool air inlet 150I is provided in a side of the left side surface of the box casing 150 in the figure. The cool air inlet 150I communicates with the cool air supply port 139 through the communication openings 144 of the auxiliary duct 143 in a state where the box casing 150 is mounted to the refrigerating chamber 133. Preferably, the cool air inlet 150I is formed to have the same shape and size as the cool air supply port 139 and the communication openings 144.

A first channel 150P1 is provided in the box casing 150. The first channel 150P1 is provided in a position corresponding to the cool air supply port 139 in a state where the box casing 150 is installed to the refrigerating chamber 133. The cool air of the freezing chamber 131, which is supplied through the cool air inlet 150, flows through the first channel 150P1. Further, the cool air flowing through the first channel 150P1 is delivered to a second channel 150P2, which will be described below.

In order to form the first channel 150P1, a duct member 157 is fixed to an inside of the left side surface of the box casing 150 in the figure. The duct member 157 is formed in a flat hexahedral shape in which a side face facing the inner left side surface of the box casing 150 in the figure and an upper face are opened.

In a state where the duct member 157 is fixed to the inner left side surface of the box casing 150 in the figure, the cool air inlet 150I is positioned in a region of the open side face of the duct member 157. In addition, a communication hole 158, which will be described below, is positioned in a region of the open upper face of the duct member 157. Thus, the first channel 150P1 communicates with the cool air inlet 150I and the communication hole 158. In the illustrated embodiment, a lower edge portion of the open side face of the duct member 157 is brought into close contact with a portion of the inner left side surface of the lower casing 154 in the figure corresponding to an edge portion of the cool air inlet 150I. Also, an edge portion of the open upper face of the duct member 157 is brought into close contact with a portion of the bottom surface of the lower plate 153 corresponding to an edge portion of the communication hole 158.

The communication hole 158 is provided in the left side end of the lower plate 153 in the figure to communicate with the upper portion of the first channel 150P1. The communication hole 158 is formed by cutting a portion of the left side end of the lower plate 153 in the figure, thereby causing the first channel 150P1 and the second channel 150P2 to communicate with each other. The communication hole 158 serves as a passage through which the cool air which has flowed through the first channel 150P1 is delivered to the second channel 150P2.

As shown in FIG. 3, the insulation 158A is provided on a side of an upper surface of the lower plate 153 adjacent to the communication hole 158. The insulation 158A serves to prevent dew condensation, which is generated by the cool air of the freezing chamber 131 with a relatively low temperature flowing to the second channel 150P2 through the communication hole 158.

In the meantime, the second channel 150P2 is provided in an upper portion of the box casing 150. The second channel 150P2 is defined by a bottom surface of the upper plate 152, the upper surface of the lower plate 153 and an inner surface of an upper edge portion of the lower casing 154. The cool air delivered from the first channel 150P1 through the communication hole 158 flows through the second channel 150P2.

A cool air outlet 150O is provided in a rear surface of the lower casing 154. The cool air outlet 150O serves as an outlet through which the cool air flowing through the second channel 150P2 is discharged to the outside. The cool air outlet 150O is provided in the right side end of the rear surface of the lower casing 154 in the figure which is farthest from the cool air inlet 150I and the communication hole 158. In addition, the cool air outlet 150O preferably communicates with the return duct of the refrigerating chamber 133.

In addition, as shown in FIG. 4, a cool air guide 159 is provided in the second channel 150P2, i.e., between the upper and lower plates 152 and 153. The cool air guide 159 serves to guide the cool air, which is delivered to the second channel 150P2 through the communication hole 158, to the cool air outlet 150O.

The cool air guide 159 comprises a first cool air guide 159A and a second cool air guide 159B. The first cool air guide 159A is provided in a front end of the upper cover 151 corresponding to a side opposite to the cool air outlet 150O with respect to the communication hole 158. The first cool air guide 159A extends from a side of the left side end of the upper cover 151 corresponding to the front of the communication hole 158 in FIG. 4 toward the right side end thereof.

In addition, the second cool air guide 159B is provided in a rear end of the upper cover 151 corresponding to the side opposite to the first cool air guide 159A with respect to the communication hole 158. The second cool air guide 159B is formed generally in an L-shape extending from another side of the left side end of the upper cover 151 corresponding to the rear of the communication hole 158 in FIG. 4 toward the rear end of the upper cover 151 adjacent to the left side end of the cool air outlet 150O in the figure.

However, the shapes of the first and second cool air guides 159A and 159B are not limited thereto. That is, the first and second cool air guides 159A and 159B may be formed in any shapes only if the cool air delivered to the second channel 150P2 through the communication hole 158 can be guided to the cool air outlet 150O.

In the meantime, referring back to FIG. 1, the vegetable box 160 is withdrawably installed to the mounting space 150S. The vegetable box 160 is formed in a hexahedral shape with an upper face opened. Further, the accommodation space 160S is provided in the vegetable box 160. Food such as vegetable or fruit is accommodated in the accommodation space 160S of the vegetable box 160.

The guide ribs 161 are respectively provided on both outer side surfaces of the vegetable box 160. The respective guide ribs 161 are formed to protrude outward by a predetermined length from both the side surfaces of the vegetable box 160 and to be upwardly inclined toward the front at a predetermined angle, i.e., at the same angle as the guide rails 155. In addition, a vertical height of the guide ribs 161 is determined to be less than an interval between the upper and lower guide rails 155A and 155B. The guide ribs 161 are guided by the support rollers 150*r* when the vegetable box 160 is taken in and out of the mounting space 150S, and thus, move along spaces between the upper and lower guide rails 155A and 155B.

Also, a stop flange 163 is provided on both side ends of the front surface of the vegetable box 160. A rear surface of the stop flange 163 is brought into close contact with a front surface of the contact flange 154A when the vegetable box 160 has been mounted to the mounting space 150S, whereby the stop flange 163 is to prevent the vegetable box 160 from being completely inserted into the mounting space 150S.

A duct seating portion 165 is provided in a rear end of the left side surface of the vegetable box 160 FIG. 5*a*. The duct seating portion 165 prevents the vegetable box 160 accommodated in the mounting space 150S from being interfered with the duct member 157. Thus, in a process in which the vegetable box 160 is mounted to the mounting space 150S, it is prevented that the vegetable box 160 is damaged by the duct member 157. The duct seating portion 165 is formed by stepping the rear end of the left side of the vegetable box 160 in FIG. 5*a* to the inside of the accommodation space 160S, i.e., to the right side in the figure, in correspondence with the shape and thickness of the duct member 157.

Hereinafter, a process in which the cool air supplied to the storage receptacle flows by the first embodiment of the cool air supply structure of a storage receptacle for a refrigerator according to the present invention so configured will be described in detail with reference to the accompanying drawings.

FIG. 5 shows a state where the cool air supplied by the first embodiment of the cool air supply structure of a storage receptacle for a refrigerator according to the present invention flows.

As shown in the figure, if the internal temperature of the accommodation space 160S of the vegetable box 160 mounted to the mounting space 150S of the box casing 150 is detected to be less than a predetermined value by the temperature sensor 147, the cool air supply port 139 is opened by the damper 141. Thus, the cool air of the freezing chamber 131 is supplied to the first channel 150P1 of the box casing 150 through the cool air supply port 139, the cool air inlet 150I, and the communication openings 144 of the auxiliary duct 143.

In the meantime, the cool air delivered to the first channel 150P1 is supplied to the second channel 150P2 of the box casing 150 through the communication hole 158. Then, while flowing through the second channel 150P2, the cool air delivered to the second channel 150P2 is guided to the cool air outlet 150O by the first and second cool air guides 159A and 159B.

The cool air flowing through the first and second channels 150P1 and 150P2 causes the food accommodated in the accommodation space 160S of the vegetable box 160 to be indirectly cooled. Thus, it is possible to prevent smell of other food contained in the cool air from permeating into the food accommodated in the accommodation space 160S of the vegetable box 160 or to prevent moisture in the food from being evaporated.

When the internal temperature of the accommodation space 160S of the vegetable box 160 detected by the temperature sensor 147 is higher than a predetermined value, the cool air supply port 139 is closed by the damper 141. Thus, since the cool air is no longer supplied to the first channel 150P1 of the box casing 150, the food accommodated in the accommodation space 160S of the vegetable box 160 is prevented from being excessively cooled.

In the meantime, the duct member 158 is fixed to the inner left side surface of the box casing 150. Therefore, the duct member 158 is positioned within the mounting space 150S. However, since the vegetable box 160 is provided with the duct seating portion 165 having shape and size corresponding to the duct member 158, the duct member 158 is seated on the duct seating portion 165 in a state where the vegetable box 160 is mounted to the mounting space 150S. Thus, in a process in which the vegetable box 160 is taken in and out of the mounting space 150S, the vegetable box 160 is not interfered with the duct member 158.

It will be apparent that those skilled in the art can make various modifications thereto within the scope of the technical spirit of the invention, and the true scope of the present invention should be analyzed on the basis of the appended claims.

[Mode for Invention]

Hereinafter, another embodiment of a cool air supply structure of a storage receptacle for a refrigerator according to the present invention will be described in detail with reference to the accompanying drawings.

FIG. 6 is a perspective view showing a second embodiment of the cool air supply structure of a storage receptacle for a refrigerator according to the present invention, FIG. 7 is an exploded perspective view of the second embodiment of the present invention as viewed from another angle, FIG. 8 is a sectional side view showing a major portion of the second embodiment of the present invention, FIGS. 9 and 10 are side views showing a major portion of a box casing of the second embodiment of the present invention, FIG. 11 is a partially cutaway perspective view showing the box casing of the second embodiment of the present invention, and FIG. 12 is a sectional side view showing a flow state of cool air supplied according to the second embodiment of the present invention.

As shown in the figure, a storage space is provided within the refrigerator main body 230. Such a storage space comprises a freezing chamber 231 and a refrigerating chamber 233 which are divided from each other from side to side by a barrier 235 provided in the main body 230. The freezing and refrigerating chambers 231 and 233 are provided with cool air supply ports (not shown), through which cool air subjected to heat transfer in an evaporator (not shown) is supplied, and cool air return ports (not shown), through which the cool air which has circulated in the chambers flows to the evaporator.

In addition, as shown in FIG. 7, on both side surfaces of the refrigerating chamber 233, there are provided a plurality of support projections, respectively. The support projections are provided at the same level on both the side surfaces of the refrigerating chamber 233 to extend in the fore and aft direction, respectively. The support projections are formed by causing portions of an inner case defining the refrigerating chamber 233 to respectively protrude in the directions in which the portions face each other. The support projections comprise first support projections 236A and 236B, second support projections 237A and 237B, and the third support projections 238A and 238B.

The first support projections 236A and 236B are to support a shelf 260, which will be described below. The second support projections 237A and 237B, which are positioned below the first support projections 236A and 236B, support a first box casing 270, which will be described below. In addition, the third support projections 238A and 238B are positioned below the second support projections 237A and 237B and thus support a second box casing 270', which will be described below.

In the meantime, front ends of the first, second and third support projections 236A, 237A and 238A, which are provided on the left side surface of the refrigerating chamber 233 in the figure, are respectively positioned to be spaced to the rear of the refrigerating chamber 233 from a front end of the first support projection 236B, which is provided on the right side surface of the refrigerating chamber 233 in the figure, by lengths corresponding to fore-and-aft lengths of first, second and third support pieces 256, 257 and 258 of a cool air duct 250, which will be described below. Further, front ends of the second and third support projections 237B and 238B, which are provided on the right side surface of the refrigerating chamber 233 in the figure, are positioned to be spaced to the rear of the refrigerating chamber 233 from a front end of the first support projection 236B, which is provided on the right side surface of the refrigerating chamber 233 in the figure, by a length corresponding to a fore-and-aft length of a fixing piece 245, which will be described below.

The barrier 235 is formed with a cool air supply port 239. The cool air supply port 239 functions as a passage through which the cool air circulating in the freezing chamber 231 is delivered to the cool air duct 250. Although the cool air supply port 239 is formed in a rectangular shape in the illustrated embodiment, the shape of the cool air supply port 239 is not limited thereto.

In addition, as shown in FIGS. 7 and 8 in detail, a damper 241 is provided in the barrier 235 corresponding to the cool air supply port 239. The damper 241 comprises a baffle rotatably installed and a drive motor for rotating the baffle. Since the configuration of such a damper 241 has been well known, the detailed descriptions thereof will be omitted.

The damper 241 serves to selectively open and close the cool air supply port 239 according to an internal temperature of accommodation spaces 290S and 290'S of vegetable boxes 290 and 290', which is detected by a temperature sensor S and will be described below. That is, the damper 241 opens the cool air supply port 239 only when the internal temperature of the accommodation spaces 290S and 290'S of the vegetable boxes 290 and 290' is higher than a predetermined value.

In the meantime, a fan assembly 243 is installed to a surface of the barrier 235 defining a side surface of the freezing chamber 231. The fan assembly 243 comprises a mount frame fixed to the surface of the barrier 235 adjacent to the cool air supply port 239, a fan rotatably installed to the mount frame, and a drive motor for driving the fan.

The fan assembly 243 serves to cause cool air of the freezing chamber 231 to flow to the cool air duct 250 through the cool air supply port 239. To this end, it is preferred that the fan assembly 243 operate only when the cool air supply port 239 is opened by the damper 241.

Also, referring to FIG. 7, the fixing pieces 245 are respectively provided on the right side surface of the refrigerating chamber 233 in the figure adjacent to the front ends of the second and third support projections 237B and 238B. Each of the fixing pieces 245 is formed to have a generally U-shaped cross section. A fixing protrusion 246 is provided on a front end of a bottom plate of each of the fixing pieces 245. In addition, a plurality of through-holes 247 are formed in a side surface of the fixing piece 245.

The fixing protrusions 246 protrude upward by a predetermined height and are inserted into fixing hooks 275H and 275'H of the box casings 270 and 270' (see FIG. 10). In addition, the through-holes 247 are penetrated by fasteners 247S, which are fastened to fastening holes 233H formed in the right side surface of the refrigerating chamber 233 in the figure, respectively.

Referring back to FIGS. 7 and 8, the cool air duct 250 is provided on a surface of the barrier 235 defining the side surface of the refrigerating chamber 233. The cool air duct 250 is provided with a predetermined channel 250S communicating with the cool air supply port 239. The cool air duct 250 comprises a duct main body 251 formed in a hexahedral shape with longitudinal end surfaces opened, a flange portion 253 provided in an edge portion of the duct main body 251, and a plurality of support pieces provided on the flange portion 253.

The duct main body 251 substantially defines a channel 250P of the cool air duct 250. That is, the channel 250P of the cool air duct 250 is defined between an inner surface of the duct main body 251 and the surface of the barrier 235. Further, a pair of cool air outlets are formed in the longitudinal end surfaces of the duct main body 251 parallel with the surface of the barrier 235. The cool air outlets are to allow the cool air flowing through the channel 250P of the cool air duct 250 to be supplied to channels 270P and 270'P of the box casings 270 and 270', respectively. The cool air outlets comprise a first cool air outlet 252A formed in an upper side of the longitudinal end surfaces of the duct main body 251 and a second cool air outlet 252B formed in a bottom surface of the duct main body 251.

Also, a cool air guide 252*g* is provided in the inner portion of the duct main body 251 corresponding to the channel 250P of the cool air duct 250. The cool air guide 252*g* serves to cause the same amount of the cool air delivered through the cool air supply port 239 to be supplied to the channels 270S and 270'S through the first and second cool air outlets 252A and 252B.

To this end, the cool air guide 252*g* is provided to horizontally extend in the inner portion of the duct main body 251 corresponding to the center of the cool air supply port 239, and thus, divides the channel 250P of the cool air duct 250 into upper and lower parts so that areas of their portions communicating with the cool air supply port 239 are the same. That is, the channel 250P of the cool air duct 250 is divided by the cool air guide 252*g* into an upper channel 250PA corresponding to the first cool air outlet 252A and a lower channel 250PB corresponding to the second cool air outlet 252B.

The flange portion 253 is brought into close contact with the surface of the barrier 235 defining the side surface of the refrigerating chamber 233. A fastening piece 254 is provided in a rear end of the flange portion 253. The fastening piece 254 is provided to be stepped in the direction facing the surface of the barrier 235 with respect to the flange portion 253, i.e., in the left side direction in the figure. The fastening piece 254 is inserted into a fastening slot 235*s* formed in the surface of the barrier 235. In addition, the flange portion 253 is formed with a plurality of through-holes 255. Fasteners 255*s* penetrating the through-holes 255 are respectively fastened to a plurality of fastening holes 235H formed in the side surface of the barrier 235.

The support pieces comprise the first support piece 256, the second support piece 257, and the third support piece 258. A side end of a bottom surface of the shelf 260 is supported on the first support piece 256. In addition, the first and second box casings 270 and 270' are respectively supported on the second and third support pieces 257 and 258.

The first and third support pieces 256 and 258 extend from upper and lower ends of the flange portion 253 to the right side in the figure, i.e., extend to be perpendicular to the flange portion 253 in the direction away from the surface of the barrier 235, respectively. The first to third support pieces 256, 257 and 258 are formed to extend in the fore and aft direction, thereby serving to substantially elongate the lengths of the first to third support projections 236A, 237A and 238A provided on the left side surface of the refrigerating chamber 233. In the illustrated embodiment, an upper surface of the duct main body 251 substantially functions as the second support piece 257. However, the second support piece 257 can be provided on the flange portion 253 as an additional element.

In addition, the cool air duct 250 is provided with a sensor mount 259. The sensor mount 259 is formed by depressing a portion of the flange portion 253 in the right direction in the figure, i.e., in the direction away from the surface of the barrier 235. The sensor mount 259 is brought into close contact with a side surface of the first box casing 270.

The sensor mount 259 is mounted with the temperature sensor S. The temperature sensor S serves to detect the internal temperature of the accommodation spaces 290S and 290'S of the vegetable boxes 290 and 290'. That is, the temperature sensor S substantially detects the internal temperature of the accommodation spaces 290S and 290'S of the vegetable boxes 290 and 290' by detecting a temperature of the first box casing 270 which is brought into close contact with the sensor mount 259 in a state where the temperature sensor S is installed to the sensor mount 259.

As shown in FIGS. 6 and 7, a plurality of shelves are detachably installed in the refrigerating chamber 233. Among the shelves, the shelf 260 installed in a relatively lower portion serves to divide the space (hereinafter, referred to as a vegetable chamber for convenience), in which the box casings 270 and 270' and the vegetable boxes 290 and 290' are installed, from the refrigerating chamber 233. This is to stop the heat exchange between the refrigerating chamber 233 and the vegetable chamber and thus to prevent an internal temperature of a side from being changed by another side. Both side ends of the bottom surface of the shelf 260 are supported on the first support projections 236A and 236B and the first support piece 256 of the cool air duct 250. In the illustrated embodiment, the shelf 260 among the shelves serves to divide the vegetable chamber and the refrigerating chamber 233 from each other, but it is also possible for them to be divided by an additionally configured member.

In the meantime, as shown in FIG. 7, the pair of box casings 270 and 270' are detachably installed in the vegetable chamber. Among the box casings 270 and 270', the box casing provided directly below the shelf 260 is referred to as the first box casing 270 and the box casing provided directly below the first box casing 270 is referred to as the second box casing 270'.

Mounting spaces 270S and 270'S are respectively provided in the box casings 270 and 270'. In addition, the vegetable boxes 290 and 290' are withdrawably installed in the mounting spaces 270S and 270'S of the box casings 270 and 270', respectively. The box casings 270 and 270' substantially serve to indirectly cool the food accommodated in the accommodation spaces 290S and 290'S of the vegetable boxes 290 and 290' installed in the mounting spaces 270S and 270'S. In addition, the box casings 270 and 270' comprise upper covers 271 and 271' and lower casings 274 and 274', respectively.

As shown in FIGS. 9 to 11 in detail, the upper covers 271 and 271' comprise upper plates 272 and 272' and the lower plates 273 and 273', respectively. The upper plates 272 and 272' define external appearances of upper surfaces and front upper end surfaces of the box casings 270 and 270'. The lower plates 273 and 273' are installed in inner portions of the lower casings 274 and 274' corresponding to positions below the upper plates 272 and 272'. The upper plates 272 and 272' and the lower plates 273 and 273' are respectively formed in a rectangular plate shape, wherein the lower plates 273 and 273' have a relatively small fore-and-aft length and lateral width as compared with the upper plates 272 and 272'. Further, both side ends of the upper plates 272 and 272' respectively extend by a predetermined width in the directions away from both sides of the lower casings 274 and 274', and thus bottom surfaces of both the side ends of the upper plates 272 and 272' are supported on the second support projections 237A and 237B and the second support piece 257.

Each of the lower casings 274 and 274' is formed in a hexahedral shape with front and upper portions generally opened. Contact flanges 274A are respectively provided on front ends of both side surfaces and a lower surface of each of the lower casings 274 and 274' to extend in both the lateral directions or downward. The contact flanges 274A are to prevent the vegetable boxes 290 and 290' from completely being inserted into the mounting spaces 270S and 270'S.

Support ribs 275 and 275' are respectively provided on upper ends of both the side surfaces of the lower casings 274 and 274'. The support ribs 275 and 275' are formed by allowing the upper ends of both the side surfaces and a rear surface of the lower casings 274 and 274' to extend to the outside. Bottom surfaces of edge portions of the upper plates 272 and 272' are supported on upper surfaces of the support ribs 275 and 275'.

In addition, support step portions 276 are respectively provided on rear surfaces of the lower casings 274 and 274'. The support step portions 276 are formed by rearward stepping upper ends of the rear surfaces of the lower casings 274 and 274'. Rear ends of bottom surfaces of the lower plates 273 and 273' are supported on the support step portions 276 of the lower casings 274 and 274'.

Also, as shown in FIG. 11, support rollers 270*r* and 270'*r* are respectively provided on front ends of both the inner side surfaces of the lower casings 274 and 274'. In addition, guide rails 277 and 277' are respectively provided at positions corresponding to rear portions of the support rollers 270*r* and 270'*r* on both the inner side surfaces of the lower casings 274 and 274', The support rollers 270*r* and 270'*r* and the guide rails 277 and 277' serve to guide the vegetable boxes 290 and 290' taken in and out of the mounting spaces 270S and 270'S of the box casings 270 and 270'.

The guide rails 277 and 277' comprise upper guide rails 278 and 278' and upper guide rails 279 and 279', which are formed to be upwardly inclined toward the front at a predetermined angle, i.e., at the same angle as a guide ribs 291 and 291', respectively. In addition, the upper guide rails 278 and 278' and the upper guide rails 279 and 279' are vertically spaced apart by a predetermined distance from each other. A plurality of reinforcing ribs 278A, 278'A, 279A and 279'A are provided on upper surfaces of the upper guide rails 278 and 278' and bottom surfaces of the upper guide rails 279 and 279', respectively. The reinforcing ribs 278A, 278'A, 279A and 279'A extend to be upwardly or downwardly inclined at a predetermined angle from the upper surfaces of the upper guide rails 278 and 278' and the upper surfaces of the upper guide rails 279 and 279', thereby serving to reinforce the upper guide rails 278 and 278' and the upper guide rails 279 and 279'. Further, on front ends of the upper guide rails 278 and 278', there are provided inclination guide portions 278B and 278'B, which are formed to be upwardly inclined toward the front at a relatively larger angle.

In the meantime, the box casings 270 and 270' are respectively provided with the channels 270P and 270'P. The channels 270P and 270'P are respectively defined by bottom surfaces of the upper plates 272 and 272', the upper surfaces of the lower plates 273 and 273', and inner surfaces of upper edge portions of the lower casings 274 and 274'. The cool air supplied from the cool air duct 250 flows through the channels 270P and 270'P of the box casings 270 and 270'.

To this end, as shown in FIG. 7, the box casings 270 and 270' are respectively formed with cool air inlets 270I and 270'I and cool air outlets 270O and 270'O. The cool air inlets 270I and 270'I of the box casings 270 and 270' function as inlets through which the cool air delivered from the cool air duct 250 is introduced into the channels 270S and 270'S, respectively. In addition, the cool air outlets 270O and 270'O of the box casings 270 and 270' function as outlets through which the cool air circulating in the channels 270S and 270'S are discharged to the outside, respectively.

The cool air inlet 270I of the first box casing 270 is provided in the upper end of the side surface of the lower casings 274 and 274', which defines the channel 270P. That is, the cool air inlet 270I of the first box casing 270 is substantially formed in the side surface of the first box casing 270. In addition, if the upper plate 272 slides in a state where both the side ends of its bottom surface are supported on the second support projections 237A and 237B, the cool air inlet 270I of the first box casing 270 becomes in communication with the first cool air outlet 252A of the cool air duct 250 and thus the cool air is supplied to the channel 270P of the first box casing 270.

The cool air inlet 270'I of the second box casing 270' is formed so that a portion of a side surface of the lower casing 274' defining the channel 270'P extend to the right side in FIG. 7 by a predetermined length. That is, the cool air inlet 270'I of the second box casing 270' is substantially in the upper surface of the second box casing 270'. In addition, if the upper plate 272' slides in a state where both the side ends of its bottom surface are supported on the third support projections 238A and 238B, the cool air inlet 270'I of the second box casing 270' becomes in communication with the second cool air outlet 252B of the cool air duct 250 and thus the cool air is supplied to the channel 270'P of the second box casing 270'.

The cool air outlets 270O and 270'O of the box casings 270 and 270' are respectively provided in upper left side ends of the rear surfaces of the lower casings 274 and 274' in FIG. 7 which define the channels 270P and 270'P. The cool air outlets 270O and 270'O of the box casings 270 and 270' respectively communicate with the return duct (not shown) through which the cool air of the refrigerating chamber 233 is returned to the freezing chamber 231. That is, the cool air circulating in the channels 270S and 270'S of the box casings 270 and 270' is introduced into the return duct through the cool air outlets 270O and 270'O, and then delivered to the freezing chamber 231.

However, the cool air outlets 270O and 270'O of the box casings 270 and 270' need not communicate with the return duct of the refrigerating chamber 233. That is, the cool air circulating in the channels 270S and 270'S of the box casings 270 and 270' may be discharged to the interior of the refrigerating chamber 233 through the cool air outlets 2700 and 270'O.

The cool air inlets 270I and 270'I and the cool air outlets 270O and 270'O of the box casings 270 and 270' are shown in FIG. 12 in detail. That is, the cool air inlet 270I of the first box casing 270 and the cool air inlet 270'I of the second box casing 270' are respectively formed at positions corresponding to the first cool air outlet 252A and the second cool air outlet 252B of the cool air duct 250, thus being positioned differently. However, the cool air outlet 270O of the first box casing 270 and the cool air outlet 270'O of the second box casing 270' are respectively formed at the same position corresponding to that of the return duct of the refrigerating chamber 233.

Referring back to FIGS. 9 and 10, on each side end of the bottom surfaces of the upper plates 272 and 272' and the lower plates 273 and 273', there are provided catching hooks 272H or 273H in a pair. The pair of catching hooks 272H or 273H are provided at a predetermined interval on each side end of the bottom surfaces of the upper plates 272 and 272' and the lower plates 273 and 273'. The catching hooks 272H and 273H extend downwardly from the bottom surfaces of the upper plates 272 and 272' and the lower plates 273 and 273' and then their front ends extend rearward, thereby being respectively formed in an L-shape opened to its rear.

The lower casings 274 and 274' are provided with the catching protrusions 275A, 275'A, 276A and 276'A, respectively. The catching protrusions 275A, 275'A, 276A and 276'A serve to fix the upper covers 271 and 271', i.e., the upper plates 272 and 272' and the lower plates 273 and 273', to the lower casings 274 and 274'. To this end, the catching protrusions 275A, 275'A, 276A and 276'A are respectively inserted into the catching hooks 272H and 273H in a state where the upper plates 272 and 272' and the lower plates 273 and 273' are respectively supported on the upper ends of both the side surfaces of the lower casings 274 and 274' and the support step portion 276.

Among the catching protrusions 275A, 275'A, 276A and 276'A, the respective catching protrusions 275A and 275'A inserted into the catching hooks 272H and 273H of the upper plates 272 and 272' are provided in pairs on the outer side surfaces of the support ribs 275 and have a predetermined length in the fore and aft direction. Also, among the catching protrusions 275A, 275'A, 276A and 276'A, the respective catching protrusions 276A and 276'A inserted into the catching hooks 272H and 273H of the lower plates 273 and 273' are provided on the upper ends of both the inner side surfaces of the lower casings 274 and 274' and have a predetermined length in the fore and aft direction.

The fixing hooks 275H are provided on the bottom surfaces of support ribs 275 of the lower casings 274 and 274'. The fixing hooks 275H are to respectively fix the box casings 270 and 270', which are installed in the refrigerating chamber 233, at predetermined positions. To this end, the fixing protrusions 246 of the fixing pieces 245 are selectively inserted into the fixing hooks 275H. It is preferably that each of the fixing hooks 275H be formed in a pair to protrude downwardly on the front ends of the bottom surfaces of support ribs 275 and have predetermined elasticity.

In the meantime, referring to FIG. 11, mount openings 273*s* and 273'*s* are respectively formed in central regions of the lower plates 273 and 273'. The mount openings 273*s* and 273'*s* are formed by cutting the central regions of the lower plates 273 and 273' in a rectangular shape. Edge portions of the mount openings 273*s* and 273'*s* are respectively provided with the supporting steps 273A and 273'A. The supporting steps 273A and 273'A are formed by downwardly stepping portions of the lower plates 273 and 273' corresponding to the edge portions of the mount openings 273*s* and 273'*s*.

The mount openings 273*s* and 273'*s* are mounted with humidity control materials 280 and 280'. In a state where the humidity control materials 280 and 280' are installed to the mount openings 273*s* and 273'*s*, edges of bottoms of the humidity control materials 280 and 280' are supported on the supporting steps 273A and 273'A. The humidity control materials 280 and 280' are formed by compressing porous polymer into a rectangular plate shape. The humidity control materials 280 and 280' serve to maintain relative humidity in the accommodation spaces 290S and 290'S of the vegetable boxes 290 and 290' at a predetermined value.

To this end, the humidity control materials 280 and 280' absorb moisture when the relative humidity in the accommodation spaces 290S and 290'S of the vegetable boxes 290 and 290' is higher than a predetermined value. Also, the humidity control materials 280 and 280' discharge moisture when the relative humidity in the accommodation spaces 290S and 290'S of the vegetable boxes 290 and 290' is lower than a predetermined value.

In the meantime, as shown in FIG. 7, the vegetable boxes 290 and 290' are withdrawably installed to the mounting spaces 270S and 270'S of the box casings 270 and 270', respectively. Hereinafter, the vegetable box withdrawably installed to the mounting space 270S of the first box casing 270 is referred to as a first vegetable box 290, and the vegetable box withdrawably installed to the mounting space 270S' of the second box casing 270' is referred to as a second vegetable box 290. A vegetable box 290" installed to the vegetable chamber in a position corresponding to a lower portion of the second box casing 270' is not related to the purport of the present invention, so that the detailed description thereof will be omitted.

Each of the vegetable boxes 290 and 290' is formed in a hexagonal shape with an upper portion opened. The accommodation spaces 290S and 290'S are respectively provided in the vegetable boxes 290 and 290'. Food such as vegetable or fruit is accommodated in the accommodation spaces 290S and 290'S of the vegetable boxes 290 and 290'.

The guide ribs 291 and 291' are respectively provided on both outer side surfaces of the vegetable boxes 290 and 290'. The guide ribs 291 and 291' are respectively formed to protrude outward by a predetermined length from both the side surfaces of the vegetable boxes 290 and 290' and to be upwardly inclined toward the front at a predetermined angle, In addition, a vertical height of the guide ribs 291 and 291' is determined to be less than an interval between the upper guide rails 278 and 278' and the lower guide rails 279 and 279'. The guide ribs 291 and 291' are guided by the support rollers 270*r* and 270'*r* when the vegetable boxes 290 and 290' are taken in and out of the mounting spaces 270S and 270'S of the box casings 270 and 270', and thus, slide along the guide rails 277 and 277', i.e., substantially along spaces between the upper and lower guide rails 155A and 155B.

Also, stop flanges 293 and 293' are provided on both side ends of the fronts of the vegetable boxes 290 and 290'. Rear surfaces of the stop flanges 293 and 293' are brought into close contact with front surfaces of the contact flanges 274A of the box casings 270 and 270' in a state where the vegetable boxes 290 and 290' are accommodated in the mounting spaces 270S and 270'S of the box casings 270 and 270'. In addition, grip portions 295 and 295' are respectively provided on front surfaces of the vegetable boxes 290 and 290'. The grip portions 295 and 295' are those which a user grips in order to take out the vegetable boxes 290 and 290' by hand.

Hereinafter, a process in which the cool air supplied to the storage receptacle flows by the second embodiment of the cool air supply structure of a storage receptacle for a refrigerator according to the present invention so configured will be described in detail with reference to the accompanying drawings.

FIG. 13 shows a flow state of the cool air which is supplied by the second embodiment of the cool air supply structure of a storage receptacle for a refrigerator according to the present invention.

As shown in the figure, if the internal temperature of the accommodation space 290S of the first vegetable box 290 is detected to be less than a predetermined value by the temperature sensor S, the cool air supply port 239 is opened by the damper 241. At the same time, the fan assembly 243 operates, so that the cool air of the freezing chamber 231 is delivered to the channel 250P of the cool air duct 250 through the cool air supply port 239.

The cool air delivered to the channel 250P of the cool air duct 250 are respectively supplied to the channel 270P of the first box casing 270 and the channel 270'P of the second box casing 270' through the cool air inlet 270I of the first box casing 270 and the cool air inlet 270'I of the second box casing 270', which communicate with the first cool air outlet 252A and the second cool air outlet 252B, by the continuous operation of the fan assembly 243. At this time, the cool air guide 252*g* of the cool air duct 250 will cause the same amount of the cool air to be respectively supplied to the channel 270P of the first box casing 270 and the channel 270P of the second box casing 270'.

That is, about a half of the cool air delivered to the channel 250P of the cool air duct 250 through the cool air supply port 239 flows through the upper channel 250PA divided by the cool air guide 252*g* and is supplied to the channel 270P of the first box casing 270 through the first cool air outlet 252A.

Also, the other half of the cool air delivered to the channel 250P of the cool air duct 250 through the cool air supply port 239 flows through the lower channel 250PB divided by the cool air guide 252*g* and is supplied to the channel 270'P of the second box casing 270' through the second cool air outlet 252B.

In addition, the cool air supplied to the channels 270P and 270'P of the box casings 270 and 270' circulates therein and simultaneously indirectly cools the food accommodated in the accommodation spaces 290S and 290'S of the vegetable boxes 290 and 290', respectively. Therefore, it is possible to prevent smell of other food contained in the cool air from permeating into the food accommodated in the accommodation spaces 290S and 290'S of the vegetable boxes 290 and 290' or to prevent moisture in the food from being evaporated.

At this time, the humidity control materials 280 and 280' absorb or discharge moisture depending on the relative humidity in the accommodation spaces 290S and 290'S of the vegetable boxes 290 and 290'. Thus, the relative humidity in the accommodation spaces 290S and 290'S of the vegetable boxes 290 and 290' are maintained at a predetermined value, so that an amount of the moisture in the food accommodated in the accommodation spaces 290S and 290'S of the vegetable boxes 290 and 290' can be maintained at a certain level.

In the meantime, when the internal temperature of the accommodation space 290S of the first vegetable box 290 detected by the temperature sensor S is higher than a predetermined value, the cool air supply port 239 is closed by the damper 241. At the same time, the fan assembly 243 stops operating. Thus, since the cool air is no longer supplied to the channels 270P and 270'P of the box casings 270 and 270', the food accommodated in the accommodation spaces 290S and 290'S of the vegetable boxes 290 and 290' is prevented from being excessively cooled.

Hereinafter, a further embodiment of the cool air supply structure of a storage receptacle for a refrigerator according to the present invention will be described in detail with reference to the accompanying drawing.

FIG. 13 is a sectional side view showing a major portion of a third embodiment of the cool air supply structure of a storage receptacle for a refrigerator according to the present invention.

In the present embodiment, a cool air duct 350 is provided with a control knob 352N. The control knob 352N selectively controls open areas of first and second cool air outlets 352A and 352B. That is, the control knob 352N controls an amount of the cool air supplied to a channel 370P of a first box casing 370 and a channel 370'P of a second box casing 370' through the first and second cool air outlets 352A and 352B, and thus, substantially serves to selectively cool indirectly first and second vegetable boxes 390 and 390'.

To this end, a duct main body 351 of the cool air duct 350 is formed with guide slots 351*s*. The guide slots 351*s* are respectively formed in both longitudinal surfaces adjacent to a surface of the duct main body 351 in which the first cool air outlet 352A is formed, i.e., in the front and rear surfaces of the cool air duct 350 in the figure. The guide slots 351*s* are formed to extend in the longitudinal direction so that their upper ends are adjacent to the first cool air outlet 352A. In addition, lower ends of the guide slots 351*s* are round toward the second cool air outlet 352B. Therefore, each of the guide slots 351*s* is generally formed in a J-shape.

The control knob 352N is made of a flexible material and moves along the guide slots 351*s*. In addition, the control knob 352N is provided with an operating portion (not shown), which penetrates the guide slot provided in the front surface of the duct main body 351 in the figure among the guide slots 351*s* and then is exposed to the front. The operating portion is gripped by a user to cause the control knob 352N to move along the guide slots 351*s*. The control knob 352N is formed to have a size such that its front and rear ends are brought into close contact with the inner front and rear surfaces of the duct main body 351 and the control knob 352N move along the guide slots 351*s* and thus can individually close the first and second cool air outlets 352A and 352B.

Hereinafter, the process of controlling the cool air by the third embodiment of the cool air supply structure of a storage receptacle for a refrigerator according to the present invention will be described in detail with reference to the accompanying drawings.

FIGS. 14 and 15 are sectional side views showing a process in which cool air is controlled by the third embodiment of the cool air supply structure of a storage receptacle for a refrigerator according to the present invention.

First, as shown in FIG. 14, in a case where the second vegetable box 390' is not used, the control knob 352N is caused to move downwardly along the guide slots 351*s*. Therefore, the control knob 352N closes the second cool air outlet 352B, whereby the cool air is not supplied to the channel 370'P of the second box casing 370'. At this time, since the first cool air outlet 352A is in an open state, the cool air is supplied to the channel 370P of the first box casing 370.

In addition, as shown in FIG. 15, in a case where the first vegetable box 390 is not used, the control knob 352N is caused to move upwardly along the guide slots 351*s*. Therefore, the control knob 352N closes the first cool air outlet 352A, whereby the cool air is not supplied to the channel 370P of the first box casing 370. However, since the second cool air outlet 352B is in an open state, the cool air is supplied to the channel 370'P of the second box casing 370' through the second cool air outlet 352B.

Meanwhile, in a case where all of the vegetable boxes 390 and 390' are used, the control knob 352N is positioned as shown in FIG. 13. Thus, all of the first and second cool air outlets 352A and 352B are opened, so that the cool air is supplied to all of the channels 370P and 370'P of the first and second box casings 370 and 370'.

It will be apparent that those skilled in the art can make various modifications thereto within the scope of the technical spirit of the invention, and the true scope of the present invention should be analyzed on the basis of the appended claims.

INDUSTRIAL APPLICABILITY

According to the present invention, food accommodated in a storage receptacle is indirectly cooled by cool air which flows through a channel provided in a portion above the storage receptacle. Thus, it is possible to prevent smell of other food stored in a refrigerating chamber from permeating into the food accommodated in the storage receptacle or to prevent moisture in the food from being evaporated, and at the same time the food can be prevented from being weakly or excessively cooled. Thus, it is possible to keep the food accommodated in the storage receptacle to be in a fresher state for a long time.

In addition, according to the present invention, the storage receptacle and a space in which a box casing and a cool air duct are installed are divided from each other by a partition plate, i.e., a shelf provided directly above the storage receptacle. Thus, it is possible to minimize the phenomenon that the food accommodated in the accommodation space is affected by other food accommodated in the refrigerating chamber.

Also, in the present invention, food is seated on the shelf provided directly above the storage receptacle. Thus, when directly placing food on the upper surface of the box casing, it is possible to prevent the problem that the food is excessively cooled by the cool air that flows through the channel of the box casing.

Furthermore, according to the present invention, only if a temperature detected by a temperature sensor for measuring an internal temperature of the accommodation space of the storage receptacle is higher than a predetermined value, the cool air is supplied to the channel. Therefore, it is possible to use the refrigerator more economically.

Also, in the present invention, a cool air guide, which is to divide cool air as many as the number of the storage receptacles and to uniformly deliver the cool air, is provided in the cool air duct through which the cool air for indirectly cooling the storage receptacle flows. Therefore, it is possible to use the refrigerator more effectively by more uniformly supplying the cool air to a plurality of storage receptacles.

In addition, according to the present invention, a control knob, which is provided in the cool air duct supplying the cool air to the storage receptacles, makes it possible to selectively supply the cool air to a plurality of the storage receptacles. Thus, depending on the use or not of the storage receptacles, it is possible to more effectively use the refrigerator.

The invention claimed is:

1. A cool air supply structure of a storage receptacle for a refrigerator, comprising: a cool air duct installed to a side surface of a refrigerating chamber, the cool air duct being formed with a first channel through which cool air flows, the cool air being supplied from a cool air supply source through a cool air supply port, the cool air supply port is formed in the side surface of the refrigerating chamber; at least a pair of box casings divided from the refrigerating chamber, each of the box casings having a mounting space in which a storage receptacle is detachably installed and having a second channel through which the cool air supplied from the cool air duct flows to indirectly cool food accommodated in an accommodation space of the storage receptacle; the cool air duct having a duct main body; and the first channel being defined between an inner surface of the duct main body and the side surface of the refrigerating chamber, and a flange portion provided in an edge portion of the duct main body to be brought into close contact with the side surface of the refrigerating chamber; and a cool air control means provided in a side of the cool air duct and controlling an amount of cool air supplied to the second channel of the box casing, the cool air control means includes a control knob moving along a guide slot formed in the duct main body.

2. The cool air supply structure as claimed in claim 1, wherein the cool air duct comprises a duct main body formed in a hexahedral shape with a longitudinal end surface opened.

3. The cool air supply structure as claimed in claim 2, wherein the duct main body is formed with at least of a pair of cool air outlets for supplying cool air to the respective channels of the box casings, and each of the box casings is formed with a cool air inlet that communicates with the cool air outlet and is supplied with the cool air.

4. The cool air supply structure as claimed in claim 3, wherein the flange portion is formed with at least one through-hole which a fastener penetrates, the fastener being fastened to a fastening hole formed in the side surface of the refrigerating chamber, and the flange portion is provided with at least one fastening piece, the fastening piece being inserted into a fastening slot formed in the side surface of the refrigerating chamber.

5. The cool air supply structure as claimed in claim 1, wherein the cool air duct is formed with a pair of cool air outlets for supplying the box casings with cool air, and each of the box casings is formed with a cool air inlet, which communicates with the cool air outlet of the cool air duct and through which cool air flows to the second channel, and a cool air outlets, through which the cool air that flows through the second channel is discharged to the outside.

6. The cool air supply structure as claimed in claim 5, wherein the cool air outlets of the box casings respectively communicate with a cool air return port, which is formed in a side of the refrigerating chamber and into which the cool air circulating in the refrigerating chamber is introduced.

7. The cool air supply structure as claimed in claim 1, wherein the cool air duct is provided with a cool air guide for dividing the first channel of the cool air duct into a predetermined number of sub-channels to divide the cool air and supply the cool air to the second channels of the respective box casings.

8. The cool air supply structure as claimed in claim 7, wherein the cool air guide is provided in the duct main body and divides the first channel of the cool air duct into sub-channels to have the same area through which the sub-channels communicate with the cool air supply port.

9. The cool air supply structure as claimed in claim 8, wherein the duct main body has a first cool air outlet and a second cool air outlet formed in an upper portion of a longitudinal end surface and a bottom surface of the duct main body to supply the cool air to the second channels of the box casings, respectively, and the cool air guide divides the first channel of the cool air duct into upper and lower parts so that amounts of the cool air supplied to the second channels of the box casings through the first and second cool air outlets are the same.

10. The cool air supply structure as claimed in claim 1, wherein the cool air control means selectively controls open areas of first and second cool air outlets respectively formed in an upper portion of the longitudinal end surface and a bottom surface of the duct main body.

11. The cool air supply structure as claimed in claim 1, wherein the guide slot is formed in the duct main body to have an upper end adjacent to the first cool air outlet and a lower end rounding toward the second cool air outlet, and the control knob is formed of a flexible material.

12. The cool air supply structure as claimed in claim 1, further comprising a support means for supporting the box casing.

13. The cool air supply structure as claimed in claim 12, wherein the support means includes support projections, which are provided on both side surfaces of the refrigerating chamber to extend in a fore and aft direction and support both side ends of the box casing.

14. The cool air supply structure as claimed in claim 13, wherein the cool air duct is positioned adjacent to a front end of the support projection that is provided on the side surface of the refrigerating chamber, and the cool air duct is provided with a support piece, which is formed in a longitudinal direction of the support projection and substantially elongates a length of the support projection.

15. The cool air supply structure as claimed in claim 14, wherein the duct main body is formed in a hexahedral shape with a longitudinal end surface opened, and the support piece is provided on any one of upper and lower ends of the flange portion.

16. The cool air supply structure as claimed in claim 12, further comprising a fixing means for fixing the box casing supported by the support means.

17. The cool air supply structure as claimed in claim 16, wherein the fixing means comprises a fixing protrusion provided on a fixing piece positioned adjacent to a front end of the support projection provided on the side surface of the refrigerating chamber corresponding to a side opposite to the cool air duct, and a fixing hook provided on a lower casing, the fixing protrusion being selectively inserted into the fixing hook, the lower casing being formed in a shape corresponding to both side surfaces and rear and bottom surfaces of the storage receptacle, both side surfaces and an upper end of a rear surface of the lower casing being fixed to a bottom surface of the box casing, the lower casing defining the mounting space which the storage receptacle is taken in and out of.

18. The cool air supply structure as claimed in claim 1, wherein a humidity control material is provided in a side of the box casing to maintain humidity in the accommodation space of the storage receptacle at a predetermined level.

19. The cool air supply structure as claimed in claim 18, wherein the humidity control material is formed by compressing porous polymer into a rectangular plate shape, the porous polymer absorbing moisture when relative humidity in the accommodation space of the storage receptacle is higher than a predetermined value and discharging moisture when relative humidity in the accommodation space of the storage receptacle is lower than the predetermined value.

20. The cool air supply structure as claimed in claim 19, wherein the humidity control material is installed in a mount opening formed in an inner portion of the box casing corresponding to a ceiling of the mounting space.

21. The cool air supply structure as claimed in claim 20, wherein an edge of a bottom of the humidity control material is supported on a supporting step, the supporting step being formed by downwardly stepping a portion of the box casing corresponding to an edge portion of the mount opening.

22. The cool air supply structure as claimed in claim 1, further comprising a temperature sensor for detecting an internal temperature of the accommodation space of the storage receptacle, and a damper for selectively opening and closing the cool air supply port, wherein the cool air supply port is opened by the damper only when an internal temperature of the accommodation space of the storage receptacle detected by the temperature sensor is higher than a predetermined value.

23. The cool air supply structure as claimed in claim 22, wherein the temperature sensor is installed to a sensor mount provided on a side of the cool air duct.

24. The cool air supply structure as claimed in claim 23, wherein the temperature sensor is brought into contact with a side of the box casing.

25. The cool air supply structure as claimed in claim 24, wherein the damper is installed in a barrier corresponding to the cool air supply port, the barrier dividing the refrigerating chamber and a freezing chamber from each other.

26. The cool air supply structure as claimed in claim 1, further comprising a fan assembly for causing cool air of the cool air supply source to flow toward the cool air supply port.

27. The cool air supply structure as claimed in claim 26, wherein the fan assembly is installed to a surface defining a surface of a freezing chamber side of a barrier corresponding to an opposite side of the cool air duct, the barrier dividing the refrigerating chamber and the freezing chamber from each other.

28. The cool air supply structure as claimed in claim 27, wherein the fan assembly comprises a mount frame fixed to the surface of the freezing chamber side of the barrier adjacent to the cool air supply port, a fan rotatably installed to the mount frame, and a drive motor for driving the fan.

29. The cool air supply structure as claimed in claim 28, further comprising a damper for selectively opening and closing the cool air supply port, wherein the fan assembly is driven only when the cool air supply port is opened by the damper.

30. The cool air supply structure as claimed in claim 1, further comprising a partition plate provided in an inner portion of the refrigerating chamber corresponding to a portion directly above the box casing, the partition plate for dividing a space, in which the storage receptacle, the cool air duct and the box casings are installed, from the refrigerating chamber.

31. The cool air supply structure as claimed in claim 30, wherein support projections for supporting the partition plate are provided on both side surfaces of the refrigerating chamber to extend in a fore and aft direction.

32. The cool air supply structure as claimed in claim 31, wherein the cool air duct is positioned adjacent to a front end of the support projection provided on the side surface of the refrigerating chamber, and a support piece is provided on a side of the cool air duct, the support piece being formed in a longitudinal direction of the support projection and substantially elongating a length of the support projection.

33. The cool air supply structure as claimed in claim 32, wherein the partition plate is one of shelves detachably installed in the refrigerating chamber.

34. A refrigerator comprising the cool air supply structure of a storage receptacle as claim 1.

35. A cool air supply structure of a storage receptacle for a refrigerator, comprising: at least two box casings divided from a refrigerating chamber, each of the box casings having a storage receptacle withdrawably mounted; and a cool air duct installed to a side surface of the refrigerating chamber, the cool air duct being formed with a first channel through which cool air flows, the cool air being supplied from a cool air supply source through a cool air supply port, the cool air supply port being formed in a side surface of the refrigerating chamber, wherein the cool air duct is formed with a pair of first cool air outlets for supplying the box casings with cool air, and each of the box casings is formed with a cool air inlet, which communicates with one of the first cool air outlets of the cool air duct and through which cool air flows to a second channel, wherein amounts of the cool air respectively supplied to the second channel through the first channel are controlled by a cool air control means, wherein the cool air control means includes a control knob, which moves along a guide slot formed in the duct to control open areas of the cool air outlets formed in the duct; and a second cool air outlet, through which the cool air that flows through the second channel is discharged to the outside.

36. The cool air supply structure as claimed in claim 35, wherein the second channel is provided in an inner portion of the box casing.

37. The cool air supply structure as claimed in claim 35, wherein the cool air introduced through one of the cool air inlets of the box casing and circulating in the channel of the box casing is discharged to the outside through the cool air outlet formed in a side of each of the box casings, each of the cool air inlets being formed in one of the box casing to communicate with one of the cool air outlets formed in the cooling air duct.

38. The cool air supply structure as claimed in claim 35, wherein the first channel is divided into a predetermined number of sub-channels by a cool air guide provided in the duct, thereby dividing the cool air and supplying it to the second channels.

39. The cool air supply structure as claimed in claim 38, wherein the cool air guide divides the channel of the cool air duct into upper and lower parts so that amounts of the cool air respectively supplied to the second channels through the cool air outlets formed in the duct are the same.

40. The cool air supply structure as claimed in claim 35, wherein a humidity control material provided in a ceiling of the box casings causes humidity in the accommodation space of the storage receptacle to be maintained at a predetermined level.

41. The cool air supply structure as claimed in claim 40, wherein the humidity control material is formed by compressing porous polymer into a rectangular plate shape, the porous polymer absorbing moisture when relative humidity in the accommodation space of the storage receptacle is higher than a predetermined value and discharging moisture when relative humidity in the accommodation space of the storage receptacle is lower than the predetermined value.

42. The cool air supply structure as claimed in claim 35, wherein the cool air supply port that supplies cool air to the channel of the box casing is opened by a damper only when an internal temperature of the accommodation space of the storage receptacle detected by the temperature sensor is higher than a predetermined value.

43. The cool air supply structure as claimed in claim 42, wherein a fan assembly is driven and the cool air of the cool air supply source flows toward the cool air supply port only when the cool air supply port is opened by the damper.

44. The cool air supply structure as claimed in claim 35, wherein a portion of the refrigerating chamber in which the box casing is installed is divided from the refrigerating chamber by a partition plate detachably installed in a portion above the box casing.

45. The cool air supply structure as claimed in claim 44, wherein the partition plate is one of shelves detachably installed in the refrigerating chamber.

46. The cool air supply structure as claimed in claim 35, wherein each storage receptacle is guided by a guide means in a process in which the storage receptacle is taken in and out of each box casing.

47. The cool air supply structure as claimed in claim 46, wherein the guide means comprises guide ribs respectively provided on both outer side surfaces of each storage receptacle, support rollers respectively provided on front ends of both inner side surfaces of the box casing to guide movement of the guide ribs in a process in which each storage receptacle is taken in and out of each box casing, and guide rails respectively provided on both inner side surfaces of the box casing corresponding to rear portions of the support rollers.

48. The cool air supply structure as claimed in claim 47, wherein the guide ribs are formed to be inclined at a predetermined angle toward the front, and the guide rails ribs are formed to be upwardly inclined toward the front in correspondence with the guide ribs.

49. The cool air supply structure as claimed in claim 48, wherein each of the guide rails comprises upper and lower guide rails vertically spaced apart by a predetermined interval, the guide rib sliding along a space therebetween, and the support rollers are provided on the front ends of both the inner side surfaces of the box casing corresponding to the front of the lower guide rails.

50. The cool air supply structure as claimed in claim 49, wherein reinforcing ribs for reinforcing the upper and lower guide rails are provided on an upper surface of the upper guide rail and a bottom surface of the lower guide rail.

51. The cool air supply structure as claimed in claim 50, wherein an inclination guide portion is formed in a front end of the upper guide rail to be upwardly inclined toward the front at a relatively larger angle, thereby guiding the moving rail to slide along the lower guide rail in a process in which each storage receptacle is accommodated in each box casing.

* * * * *